US009741196B2

(12) United States Patent
Yamagami et al.

(10) Patent No.: US 9,741,196 B2
(45) Date of Patent: Aug. 22, 2017

(54) AUTOMATIC VENDING MACHINE

(71) Applicants: FUJI ELECTRIC CO., LTD., Kawasaki-shi (JP); THE COCA-COLA COMPANY, Atlanta, GA (US)

(72) Inventors: Yuuhei Yamagami, Kawasaki (JP); Koji Sugimoto, Kawasaki (JP); Yasuhiro Yamazaki, Tokyo (JP)

(73) Assignees: FUJI ELECTRIC CO., LTD., Kawasaki-shi, Kanagawa (JP); THE COCA-COLA COMPANY, Atlanta, GA (US)

( * ) Notice: Subject to any disclaimer, the term of this patent is extended or adjusted under 35 U.S.C. 154(b) by 471 days.

(21) Appl. No.: 14/356,334

(22) PCT Filed: Sep. 28, 2012

(86) PCT No.: PCT/JP2012/075114
§ 371 (c)(1),
(2) Date: May 5, 2014

(87) PCT Pub. No.: WO2013/073296
PCT Pub. Date: May 23, 2013

(65) Prior Publication Data

US 2014/0312053 A1 Oct. 23, 2014

(30) Foreign Application Priority Data

Nov. 14, 2011 (JP) ..... 2011-248931

(51) Int. Cl.
*G07F 9/10* (2006.01)
*F25D 17/06* (2006.01)
(Continued)

(52) U.S. Cl.
CPC ..... *G07F 9/105* (2013.01); *F25D 17/06* (2013.01); *G07F 11/08* (2013.01); *F25D 17/045* (2013.01);
(Continued)

(58) Field of Classification Search
CPC . G07F 9/105; G07F 11/08; G07F 5/00; G07F 7/00; G07F 11/002; F25D 17/06;
(Continued)

(56) References Cited

U.S. PATENT DOCUMENTS 5,347,827 A 9/1994 Rudick et al.
5,402,654 A * 4/1995 Rudick ..... A47F 3/0408 62/448
(Continued)

FOREIGN PATENT DOCUMENTS

CN 1092854 A 9/1994
CN 101097643 A 1/2008
(Continued)

OTHER PUBLICATIONS

PCT, "International Search Report for International Application No. PCT/JP2012/075114".
(Continued)

*Primary Examiner* — Mohammad M Ali
(74) *Attorney, Agent, or Firm* — Manabu Kanesaka

(57) ABSTRACT

A controller, when a normal cooling operation is being performed, forward-drives a lower-side and an upper-side in-box blower fans, thereby causing internal air cooled by an evaporator to circulate within a commodity storage box in such a way that it enters a rear face duct through a lower-side opening and is discharged from an upper-side opening, and when a cold-maintaining operation is being performed, stops driving the lower-side and the upper-side in-box blower fans, and when a cooling recovery operation is being per-
(Continued)

formed, forward-drives the lower-side in-box blower fan and reverse-drives the upper-side in-box blower fan, thereby causing internal air cooled by the evaporator to enter the rear face duct through the lower-side opening and causing internal air to enter the rear face duct through the upper-side opening, and also causing internal air entered the rear face duct to be discharged from the intermediate opening.

14 Claims, 18 Drawing Sheets

(51) Int. Cl.
*G07F 11/08* (2006.01)
*F25D 17/04* (2006.01)
*F25D 31/00* (2006.01)

(52) U.S. Cl.
CPC .... *F25D 31/007* (2013.01); *F25D 2317/0682* (2013.01); *F25D 2317/0684* (2013.01)

(58) Field of Classification Search
CPC ..... F25D 17/045; F25D 31/007; F25D 2317/0684; F25D 2317/0682
USPC ..... 221/1, 9, 150 R, 150 A; 62/229
See application file for complete search history.

(56) References Cited

U.S. PATENT DOCUMENTS 5,417,079 A 5/1995 Rudick et al.
5,417,081 A 5/1995 Rudick et al.
6,253,954 B1 * 7/2001 Yasaka ..... G07F 11/42 221/131
6,378,324 B1 * 4/2002 Percy ..... F25D 19/02 221/150 R
2001/0039802 A1 * 11/2001 Barrash ..... F25B 9/14 62/6
2002/0117508 A1 * 8/2002 Chang ..... G07F 11/54 221/2
2003/0146239 A1 * 8/2003 Beauregard ..... G07F 11/32 221/307
2004/0000154 A1 * 1/2004 Schanin ..... F25D 29/00 62/157
2007/0125104 A1 * 6/2007 Ehlers ..... F25D 27/005 62/157
2007/0212104 A1 * 9/2007 Miyamoto ..... G03G 21/206 399/92
2009/0090734 A1 * 4/2009 Wittern, Jr. ..... F25D 17/065 221/1
2009/0173093 A1 7/2009 Sueda et al.
2012/0048115 A1 * 3/2012 Crabtree ..... G07F 19/201 95/273

FOREIGN PATENT DOCUMENTS

CN 102183714 A 9/2011
JP 2000-105860 A 4/2000
JP 2000-200388 A 7/2000

OTHER PUBLICATIONS

China Patent Office, "Office Action for CN 201280055721.1," Dec. 1, 2015.
Canada Patent Office, "Office Action for CA 2854916," Dec. 2, 2015.

* cited by examiner

AUTOMATIC VENDING MACHINE

RELATED APPLICATIONS

The present application is National Phase of International Application No. PCT/JP2012/075114 filed Sep. 28, 2012, and claims priority from Japanese Application No. 2011-248931, filed Nov. 14, 2011.

TECHNICAL FIELD

The present invention relates to an automatic vending machine that sells commodities such as beverages in cans or beverages in PET bottles.

BACKGROUND ART

Conventionally, automatic vending machines that sell commodities such as beverages in cans or beverages in PET bottles are provided with a main body cabinet, which is the automatic vending machine main body. The main body cabinet is formed as a thermally insulated housing in the shape of a rectangular cuboid the front face of which is open. An external door and an internal door are provided at the front face of the main body cabinet and a commodity storage box is provided therein. The external door is for opening and closing the front face opening of the main body cabinet. The internal door is for opening and closing the front face of the commodity storage box. The commodity storage box has a thermally insulating construction, and a commodity-accommodating device and a rear face duct are provided therein.

The commodity-accommodating device vertically accommodates commodities that have been introduced thereinto, and dispenses the lowermost commodity when it receives a sell command. Commodities that have been dispensed by the commodity-accommodating device can be removed via a commodity removal port provided in the external door.

The rear face duct is provided at the rear face of the commodity storage box, and it is provided with an upper opening in a position corresponding to an upper region of the commodity-accommodating device, and is provided with a lower opening in a position corresponding to a lower portion of the commodity-accommodating device. An upper in-box blower fan is provided in front of the upper opening, and a lower in-box blower fan is provided in front of the lower opening. The rear face duct is also provided with an evaporator. The evaporator comprises cooling means which cool the air surrounding itself, and together with a compressor, condenser and the like which are provided outside the commodity storage box, constitutes a refrigeration cycle.

In such an automatic vending machine, if all of the commodities accommodated in the commodity-accommodating device are to be cooled then the upper in-box blower fan is driven. By this means air that has been introduced into the rear face duct via an inlet in the lower portion of said rear face duct is cooled by the evaporator and is discharged through the upper opening. The discharged air cools the commodities accommodated in the commodity-accommodating device by passing through said commodity-accommodating device in a downward direction, after which it is once again introduced into the rear face duct via the inlet, and circulates. On the other hand, if only some of the commodities accommodated in the commodity-accommodating device are to be cooled, then the lower in-box blower fan is driven. By this means air that has been introduced into the rear face duct via the inlet is cooled by the evaporator and is discharged through the lower opening. The discharged air cools the commodities accommodated in the lower portion of the commodity-accommodating device by passing through the lower portion of said commodity-accommodating device in a downward direction, after which it is once again introduced into the rear face duct via the inlet, and circulates (see for example patent literature article 1).

PRIOR ART LITERATURE

Patent Literature

Patent literature article 1: Japanese Patent Publication No. 2000-105860

SUMMARY OF THE INVENTION

Problems to be Resolved by the Invention

However, in an automatic vending machine such as that discussed hereinabove, in order to reduce the amount of electric power consumed during periods of high electric power demand, for example during the summer, it is known to perform a cold-maintaining operation in which the equipment that cools the commodities is not driven during said period. In recent years in particular there have been demands for the cold-maintaining operation time to be lengthened.

Although this is not stated explicitly in patent literature article 1 discussed hereinabove, when a cold-maintaining operation is to be performed in the abovementioned automatic vending machine, a cooling down operation whereby the commodities accommodated in the commodity-accommodating device are sufficiently cooled is performed by driving the upper in-box blower fan, prior to performing said cold-maintaining operation. By performing this cooling down operation all of the commodities in the commodity-accommodating device are sufficiently cooled, and in particular it is thought that commodities on the upper side of the commodity-accommodating device are cooled more than commodities on the lower side thereof. If the cold-maintaining operation is performed after the cooling down operation, commodities on the lower side of the commodity-accommodating device are maintained in a desired cooled temperature range by means of cold air that has been cooled by the commodities on the upper side, but the temperature of the commodities on the upper side gradually increases. If the time required for the cold-maintaining operation is lengthened, then only a few of the commodities in the lower portion of the commodity-accommodating device are maintained in the cooled temperature range, and the temperature of the commodities increases gradually with increasing height.

Then, after the cold-maintaining operation is complete, a cooling recovery operation is performed whereby the equipment that was not being driven during the cold-maintaining operation is driven and the upper in-box blower fan is driven, thereby cooling the commodities in the commodity-accommodating device, but the commodities in the commodity-accommodating device are gradually cooled from the upper side by means of air discharged from the upper opening, and commodities on the lower side of the commodity-accommodating device are not cooled, the temperature thereof gradually increasing such that it exceeds the cooled temperature range, and since time is required to cool said commodities on the lower side to the desired cooling temperature there is a danger that as a result commodity sales opportunities will be lost. The danger that commodity sales opportunities will be lost becomes more marked as the time required for the cold-maintaining operation becomes longer.

The present invention takes account of the abovementioned situation, and aims to provide an automatic vending machine with which a lengthening of the commodity cold-maintaining operation time is achieved without the danger of commodity sales opportunities being lost.

In order to achieve the abovementioned objective, the automatic vending machine according to the present invention is an automatic vending machine comprising an automatic vending machine main body, an opening formed in the front face of which is opened and closed by means of a door body and inside which a commodity storage box is defined, a commodity-accommodating device which is provided inside the abovementioned commodity storage box and which vertically accommodates commodities that have been introduced thereinto and dispenses the lower most commodity when it receives a sell command, and cooling means provided in the abovementioned commodity storage box for cooling the atmosphere inside said commodity storage box, characterized in that it is provided with control means which, when a normal cooling operation is being performed, drive a lower-side in-box blower fan provided in the vicinity of a lower-side opening of a duct disposed vertically in the abovementioned commodity storage box and drive an upper-side in-box blower fan provided in the vicinity of an upper-side opening formed further up the abovementioned duct than the abovementioned lower-side opening, thereby causing internal atmosphere which has been caused to enter the abovementioned duct through the abovementioned lower-side opening to circulate within the abovementioned commodity storage box in such a way that it is discharged from the abovementioned upper-side opening, thus cooling all of the commodities accommodated in the abovementioned commodity-accommodating device, and which, when on the other hand a cold-maintaining operation is being performed, stop driving the abovementioned lower-side in-box blower fan and the abovementioned upper-side in-box blower fan, and which further, when a cooling recovery operation is being performed subsequent to the abovementioned cold-maintaining operation, drive the abovementioned lower-side in-box blower fan and the abovementioned upper-side in-box blower fan, thereby causing internal atmosphere to enter the abovementioned duct through the abovementioned lower-side opening and the abovementioned upper-side opening and causing internal atmosphere which has entered the duct to be discharged from an intermediate opening provided between the abovementioned lower-side opening and the abovementioned upper-side opening thereby cooling commodities in a lower region from said intermediate opening.

Further, the automatic vending machine according to the present invention is an automatic vending machine comprising an automatic vending machine main body, an opening formed in the front face of which is opened and closed by means of a door body and inside which a commodity storage box is defined, a commodity-accommodating device which is provided inside the abovementioned commodity storage box and which vertically accommodates commodities that have been introduced thereinto and dispenses the lowermost commodity when it receives a sell command, and cooling means provided in the abovementioned commodity storage box for cooling the atmosphere inside said commodity storage box, characterized in that it is provided with control means which, when a normal cooling operation is being performed, drive at least one of a lower-side in-box blower fan provided in the vicinity of a lower-side opening of a duct disposed vertically in the abovementioned commodity storage box and an upper-side in-box blower fan provided in the vicinity of an upper-side opening formed further up the abovementioned duct than the abovementioned lower-side opening in such a way that the blowing rate of said lower-side in-box blower fan is larger, thereby causing at least a portion of the internal atmosphere which has been discharged from the duct through said lower-side opening to circulate within the abovementioned commodity storage box in such a way that it enters the abovementioned duct through an intermediate opening, thus cooling commodities accommodated in a lower region of the abovementioned commodity-accommodating device, and which, when on the other hand a cold-maintaining operation is being performed, stop driving the abovementioned lower-side in-box blower fan and the abovementioned upper-side in-box blower fan, and which further, when a cooling recovery operation is being performed subsequent to the abovementioned cold-maintaining operation, drive the abovementioned lower-side in-box blower fan and the abovementioned upper-side in-box blower fan, thereby causing internal atmosphere to enter the abovementioned duct through the abovementioned lower-side opening and the abovementioned upper-side opening and causing internal atmosphere which has entered the duct to be discharged from the intermediate opening provided between the abovementioned lower-side opening and the abovementioned upper-side opening thereby cooling commodities in the lower region from said intermediate opening.

Further, the present invention is characterized in that in the abovementioned automatic vending machine the abovementioned lower-side opening is provided further toward the lower region than the abovementioned commodity-accommodating device, and the abovementioned upper-side opening is provided further toward the upper region than the abovementioned commodity-accommodating device.

Further, the present invention is characterized in that in the abovementioned automatic vending machine the abovementioned lower-side in-box blower fan is provided in front of the abovementioned lower-side opening, and the abovementioned upper-side in-box blower fan is provided in front of the abovementioned upper-side opening.

Further, the present invention is characterized in that, in the abovementioned automatic vending machine, when the abovementioned cooling recovery operation is being performed the abovementioned control means drive the abovementioned lower-side in-box blower fan and the abovementioned upper-side in-box blower fan if the internal temperature inside the abovementioned commodity storage box is equal to or less than a predefined threshold, thereby causing internal atmosphere to enter the abovementioned duct through the abovementioned lower-side opening and the abovementioned upper-side opening and causing the internal atmosphere which has entered the duct to be discharged from the abovementioned intermediate opening thereby cooling the commodities in the lower region from said intermediate opening, and if on the other hand the abovementioned internal temperature exceeds the abovementioned threshold the abovementioned lower-side in-box blower fan and the abovementioned upper-side in-box blower fan are driven, thereby causing internal atmosphere which has cooled the commodities accommodated in the abovementioned commodity-accommodating device to circulate within the abovementioned commodity storage box in such a way that it enters the abovementioned duct through the abovementioned upper-side opening and is discharged from the abovementioned lower-side opening thereby cooling the commodities accommodated in the abovementioned commodity-accommodating device.

Further, the present invention is characterized in that, in the abovementioned automatic vending machine there is provided a flapper member which is provided in such a way that it can swing in a manner whereby it opens and closes the abovementioned intermediate opening, and which in a normal condition closes the abovementioned intermediate opening by means of its own weight, whereas if the pressure inside the abovementioned duct is greater than the pressure in the commodity storage box it swings, opening the abovementioned intermediate opening.

Further, the present invention is characterized in that, in the abovementioned automatic vending machine there is provided a ventilation passage that allows internal atmosphere to pass between an internal door which constitutes the abovementioned door body and which opens and closes the front face opening of the abovementioned commodity storage box, and the abovementioned commodity-accommodating device in the abovementioned commodity storage box.

Advantages of the Invention

According to the automatic vending machine of the present invention, when a normal cooling operation is being performed, the control means drive the lower-side in-box blower fan and the upper-side in-box blower fan, thereby causing internal atmosphere which has been cooled by the cooling means and has been caused to enter the duct through the lower-side opening to circulate within the commodity storage box in such a way that it is discharged from the upper-side opening, thus cooling all of the commodities accommodated in the commodity-accommodating device, and therefore even if the operation subsequently transitions to a cold-maintaining operation, commodities on the lower side of the commodity-accommodating device, including the next commodity to be sold, can be cooled by means of cold air that flows downward having been cooled by means of the commodities on the upper side of said commodity-accommodating device. In particular, in an automatic vending machine provided with a commodity-accommodating device that dispenses the lowermost commodity, the uppermost commodity, which has been cooled the most, can be left to the last as a cooling source inside the commodity storage box, and thus the other commodities can be cooled by making effective use of said uppermost commodity. As a result, the time required for the cold-maintaining operation can be lengthened. Further, when a cooling recovery operation is being performed, the control means drive the lower-side in-box blower fan and the upper-side in-box blower fan, thereby causing internal atmosphere that has been cooled by the cooling means to enter the duct through the lower-side opening and the upper-side opening and causing internal atmosphere which has entered the duct to be discharged from the intermediate opening thereby cooling commodities in the lower region from said intermediate opening, and therefore commodities on the lower side of the commodity-accommodating device, including the next commodity to be sold, can be cooled intensively, and it is possible to prevent the commodities on the lower side from departing from the preferred cooled temperature range, and as a result loss of sales opportunity can be avoided. The present invention therefore exhibits advantages in that a lengthening of the commodity cold-maintaining operation time can be achieved and moreover there is no danger of commodity sales opportunities being lost.

Further, according to the automatic vending machine of the present invention, when a normal cooling operation is being performed, the control means drive at least one of the lower-side in-box blower fan and the upper-side in-box blower fan in such a way that the blowing rate of said lower-side in-box blower fan is larger, thereby causing at least a portion of the internal atmosphere which has been cooled by the cooling means and has been discharged from the duct through said lower-side opening to circulate within the commodity storage box in such a way that it enters the duct through the intermediate opening, thus cooling commodities accommodated in the lower region of the commodity-accommodating device, and therefore even if the operation subsequently transitions to a cold-maintaining operation, commodities on the lower side of the commodity-accommodating device, including the next commodity to be sold, can be cooled by means of cold air that flows downward having been cooled by means of the commodities on the upper side thereof. In particular, in an automatic vending machine provided with a commodity-accommodating device that dispenses the lowermost commodity, commodities on the upper side, which have been cooled the most, can be left to the last as a cooling source inside the commodity storage box, and thus the other commodities can be cooled by making effective use of said commodities on the upper side. As a result, the time required for the cold-maintaining operation can be lengthened. Further, in said normal cooling operation commodities accommodated in the lower region of the commodity-accommodating device are cooled, and therefore if there are only a few commodities accommodated in the commodity-accommodating device the commodities can be cooled efficiently without internal atmosphere being actively caused to pass through regions of the commodity-accommodating device in which there are no commodities. Further, when a cooling recovery operation is being performed, the control means drive the lower-side in-box blower fan and the upper-side in-box blower fan, thereby causing internal atmosphere that has been cooled by the cooling means to enter the duct through the lower-side opening and the upper-side opening and causing internal atmosphere which has entered the duct to be discharged from the intermediate opening thereby cooling commodities in the lower region from said intermediate opening, and therefore commodities on the lower side of the commodity-accommodating device, including the next commodity to be sold, can be cooled intensively, and it is possible to prevent the commodities on the lower side from departing from the preferred cooled temperature range, and as a result loss of sales opportunities can be avoided. The present invention therefore exhibits advantages in that a lengthening of the commodity cold-maintaining operation time can be achieved and moreover there is no danger of commodity sales opportunities being lost.

MODES OF EMBODYING THE INVENTION

Preferred embodiments of the automatic vending machine according to the present invention will now be described with reference to the accompanying drawings.

Embodiment 1

Figure 1:
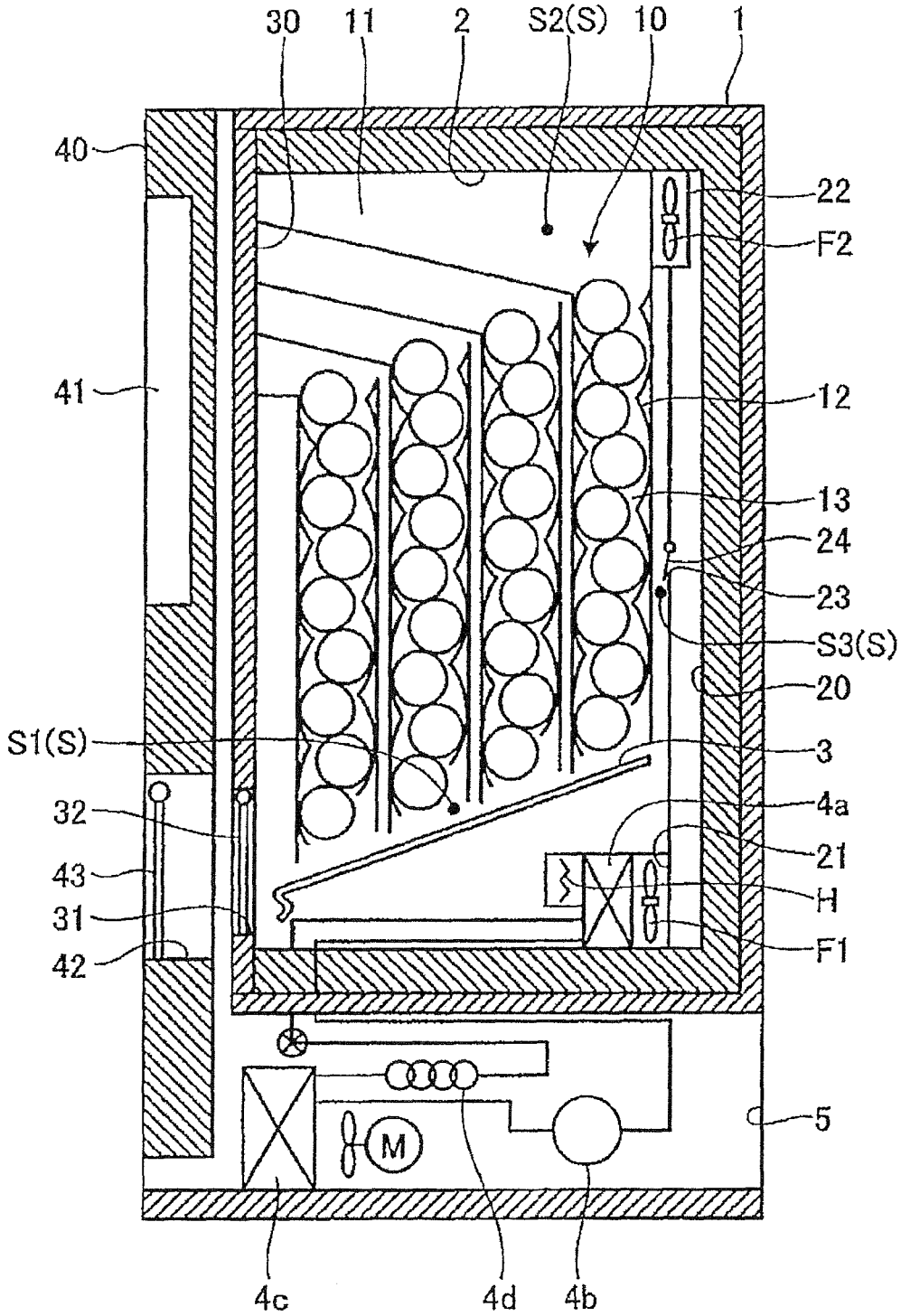
FIG. 1 is a cross-sectional side view illustrating an automatic vending machine, being embodiment 1 of the present invention.

FIG. 1 is a cross-sectional side view illustrating an automatic vending machine, being embodiment 1 of the present invention. The automatic vending machine shown here by way of example sells commodities such as beverages in cans or beverages in PET bottles in a cooled or heated state, and is provided with a main body cabinet 1, which is the automatic vending machine main body.

The main body cabinet 1 is configured by suitably combining a plurality of metal plates, and is configured in the shape of a rectangular cuboid the front face of which is open. A commodity storage box 2 having a thermally insulating construction the front face of which is open is provided inside the main body cabinet 1. In the present embodiment 1 the commodity storage box 2 is configured in a space enclosed by thermally insulating boards formed in advance into the shape of plates, by disposing the thermally insulating boards on the inner surfaces of the main body cabinet 1. The thermally insulating boards are not indicated specifically in the drawings, but they comprise plate-shaped members formed from a thermally insulating material such as urethane foam to the front and rear surfaces of which resin film or kraft paper are bonded as a surface material.

A commodity-accommodating rack 10, being a commodity-accommodating device, is disposed in the commodity storage box 2. In the commodity-accommodating rack 10, a serpentine commodity-accommodating region 13 extending vertically is configured by disposing passage-forming members 12 between a pair of side plates 11, and it accommodates commodities in the commodity-accommodating region 13 and on the other hand dispenses commodities starting with that in the lowermost position when it receives a commodity sell command. A plurality of commodity-accommodating racks 10 having commodity-accommodating regions 13 is disposed front to rear in the present embodiment 1.

Further, a commodity shooter 3 and a rear face duct 20 are provided in the commodity storage box 2. The commodity shooter 3 is provided in the lower region of the commodity-accommodating rack 10. The commodity shooter 3 is a flat plate-shaped member having multiple ventilation holes, and is disposed obliquely in a manner such that it becomes gradually lower from the rear toward the front of the commodity storage box 2.

Figure 2:
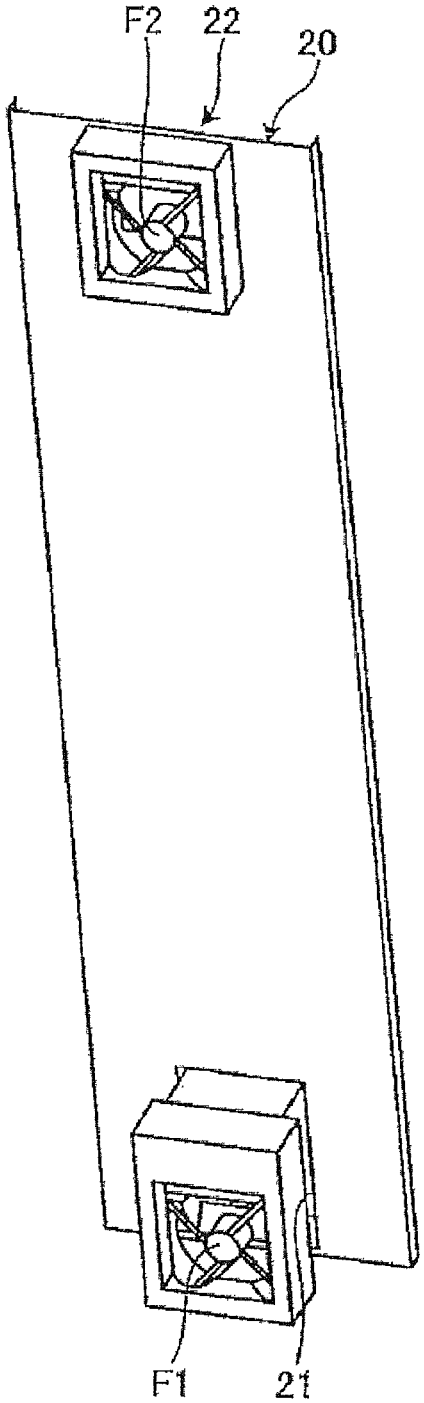
FIG. 2 is a perspective view illustrating the rear face duct constituting the automatic vending machine illustrated in FIG. 1.

The rear face duct 20 is an air-guiding passage provided on the rear face of the commodity storage box 2. FIG. 2 is a perspective view illustrating the rear face duct 20 constituting the automatic vending machine illustrated in FIG. 1. As illustrated in FIG. 2, the rear face duct 20 extends vertically, its uppermost portion being positioned higher than the commodities accommodated in the commodity-accommodating rack 10.

In the rear face duct 20, a lower-side opening 21 is provided in a position that is lower than the commodity shooter 3, and an upper-side opening 22 is provided in a position that is higher than the commodities accommodated in the commodity-accommodating rack 10.

Also, in the rear face duct 20 a lower-side in-box blower fan F1 is provided to the front of the lower-side opening 21, and an upper-side in-box blower fan F2 is provided to the front of the upper-side opening 22. The lower-side in-box blower fan F1 and the upper-side in-box blower fan F2 are circulation means which circulate internal air (internal atmosphere) in the commodity storage box 2 by being forward-driven or reverse-driven in accordance with drive commands from control means 50 discussed hereinbelow. Here, when the lower-side in-box blower fan F1 is forward-driven, internal air is emitted from the lower-side opening 21 into the rear face duct 20, whereas when it is reverse-driven, air inside the rear face duct 20 is emitted forward through the lower-side opening 21. When the upper-side in-box blower fan F2 is forward-driven, air inside the rear face duct 20 is emitted forward through the upper-side opening 22, whereas when it is reverse-driven, internal air is emitted from the upper-side opening 22 into the rear face duct 20.

Moreover, an intermediate opening 23 is provided in the rear face duct 20 at a height level corresponding to a commodity several items up from the lowermost commodity accommodated in the commodity-accommodating rack 10, between the lower-side opening 21 and the upper-side opening 22 (see FIG. 1). The intermediate opening 23 is opened and closed by means of a flapper member 24. More specifically, the flapper member 24 is provided in such a way that it can swing in a manner whereby it opens and closes the intermediate opening 23, and in a normal condition it closes the intermediate opening 23 by means of its own weight, whereas if the pressure inside the rear face duct 20 is greater than the pressure in the commodity storage box 2 it swings, opening the intermediate opening 23.

An evaporator 4*a* and a heater H are provided to the front of the lower-side in-box blower fan F1 in the lower region of the abovementioned commodity shooter 3. The evaporator 4*a* is disposed to the front of the lower-side in-box blower fan F1, being cooling means which, together with a compressor 4*b*, a condenser 4*c* and an expansion mechanism 4*d* installed in a machine chamber 5 below the commodity storage box 2, constitute a cooling unit. The heater H is disposed to the front of the evaporator 4*a*, and comprises heating means which generate heat when in an energized state.

On the other hand, the abovementioned automatic vending machine is provided with an internal door 30 and an external door (door body) 40. The purpose of the internal door 30 is to cover the front face opening of the commodity storage box 2, and it has a thermally insulating construction and is disposed at one side edge of the main body cabinet 1 such that it can open and close. A commodity-unloading port 31 is provided in the internal door 30. The commodity-unloading port 31 is opened and closed by means of a commodity-unloading door 32.

The purpose of the external door 40 is to cover the front face opening of the main body cabinet 1, and it is disposed at one side edge of the main body cabinet 1 such that it can open and close, in a position to the front of the internal door 30. A display window 41 and a commodity removal port 42, which are required for a commodity to be sold, are provided in the front face of the external door 40, and although not illustrated specifically in the drawings, a commodity selection button, a banknote insertion port, a coin slot, a return lever, a monetary amount indicator, a coin return port and the like are also provided. Here, the commodity removal port 42 is opened and closed by means of a commodity removal door 43.

Figure 3:
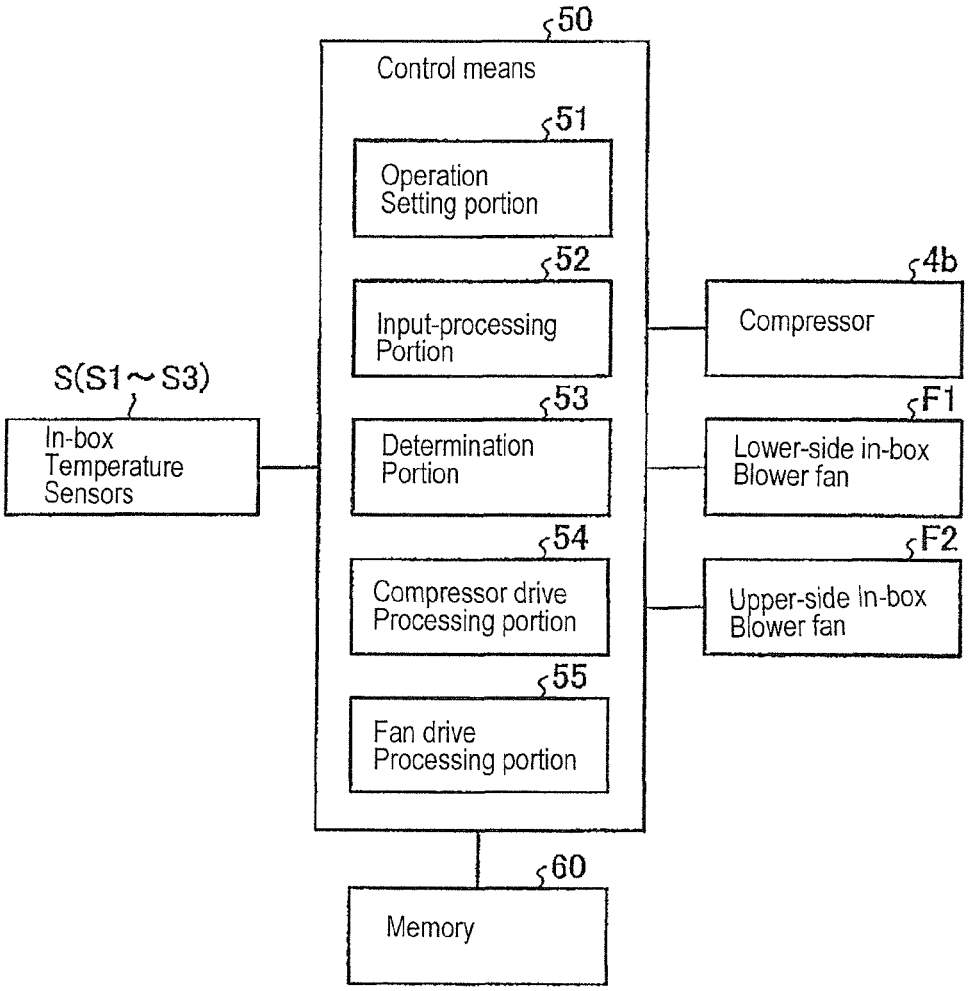
FIG. 3 is a block diagram illustrating schematically a characteristic control system of an automatic vending machine being embodiment 1 of the present invention.

FIG. 3 is a block diagram illustrating schematically a characteristic control system of an automatic vending machine being embodiment 1 of the present invention. As illustrated in FIG. 3, the automatic vending machine of the present embodiment 1 has in-box temperature sensors S and control means 50.

The in-box temperature sensors S detect the temperature inside the commodity storage box 2, and in the present embodiment 1 three temperature sensors are provided, namely a lower in-box temperature sensor S1, an upper in-box temperature sensor S2 and an intermediate in-box temperature sensor S3. The lower in-box temperature sensor S1 is provided in a lower portion of the commodity-accommodating rack 10, and the upper in-box temperature sensor S2 is provided in an upper portion of the commodity-accommodating rack 10. The intermediate in-box temperature sensor S3 is provided at a height level corresponding to the intermediate opening 23 of the rear face duct 20. When the in-box temperature sensors S have detected the in-box temperature they send this fact to the control means 50 as a detection signal.

The control means 50 control the driving of the compressor 4*b*, the lower-side in-box blower fan F1 and the upper-side in-box blower fan F2 in accordance with data and a program stored in advance in memory 60, and consist of an operation setting portion 51, an input-processing portion 52, a determination portion 53, a compressor drive processing portion 54 and a fan drive processing portion 55. It should be noted that the control means 50 may be configured integrally with a control portion which controls cash processing and selling actions in the automatic vending machine, or may be configured in a form that is independent from said control portion.

The operation setting portion 51 sets and stores operating information input via input means which are not shown in the drawings. More specifically, if a preset normal cooling operation start time is passed, it causes the normal cooling operation to be performed, and if a preset cold-maintaining operation start time is passed while said normal cooling operation is being performed, it causes the cold-maintaining operation to be performed. Further, if a preset cooling recovery operation start time is passed while the cold-maintaining operation is being performed, it causes the cooling recovery operation to be performed. In other words, it causes the automatic vending machine to perform and repeat the operations normal cooling operation→cold-maintaining operation→cooling recovery operation in accordance with a preset time schedule. It should be noted that when commodity replenishment or the like has been performed, a pull-down operation is performed for a prescribed time, after which operation transitions to the normal cooling operation.

The input-processing portion 52 input-processes detection signals provided by the in-box temperature sensors S. When the cooling recovery operation is being performed, the determination portion 53 determines the in-box temperature condition in the commodity storage box 2 by comparing the in-box temperature which has been input-processed by the input-processing portion 52 with a reference temperature (threshold) read from the memory 60.

The compressor drive processing portion 54 performs drive processing of the compressor 4*b* by providing the compressor 4*b* with a drive command or a drive stop command. The fan drive processing portion 55 performs drive processing of the lower-side in-box blower fan F1 by providing the lower-side in-box blower fan F1 with a forward-drive command, a reverse-drive command or a drive stop command, and it performs drive processing of the upper-side in-box blower fan F2 by providing the upper-side in-box blower fan F2 with a forward-drive command, a reverse-drive command or a drive stop command.

In an automatic vending machine having the configuration described hereinabove, commodities accommodated in the commodity-accommodating rack 10 are cooled as follows.

An explanation will first be given of a case in which the normal cooling operation is being performed. When the normal cooling operation is being performed, the control means 50 continue driving the compressor 4*b* via the compressor drive processing portion 54, while forward driving the lower-side in-box blower fan F1 and forward driving the upper-side in-box blower fan F2 via the fan drive processing portion 55.

Figure 4:
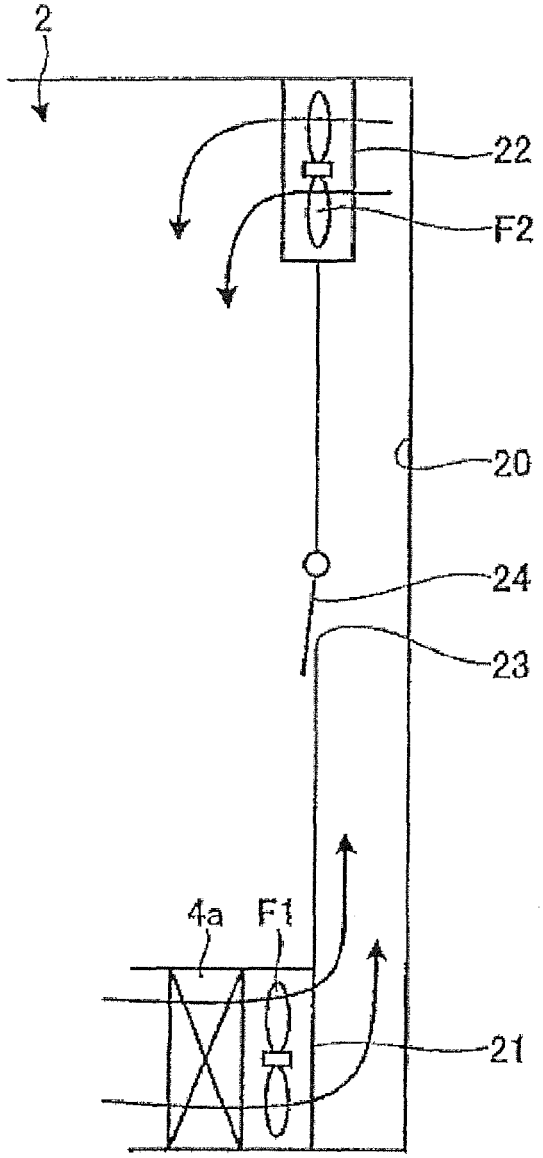
FIG. 4 is an explanatory view explaining the circulation of air inside the commodity storage box when the normal cooling operation is being performed.

By this means, as illustrated in FIG. 4, air inside the commodity storage box 2 enters the interior of the rear face duct 20 through the lower-side opening 21, and after having passed through the rear face duct 20 it circulates, being discharged from the upper-side opening 22 and passing through commodities accommodated in the commodity-accommodating rack 10. In other words, internal air which has been cooled by the evaporator 4*a* passes through the rear face duct 20 after which it is discharged from the upper-side opening 22 and passes through the commodity-accommodating rack 10, cooling commodities accommodated in said commodity-accommodating rack 10. At this time, there is not much difference between the pressure inside the rear face duct 20 and the pressure in the commodity storage box 2, and therefore the flapper member 24 closes the intermediate opening 23 by virtue of its own weight.

When said normal cooling operation is being performed, all of the commodities accommodated in the commodity-accommodating rack 10 are cooled to a desired temperature condition, commodities on the upper side being cooled more than commodities on the lower side.

If a preset cold-maintaining operation start time is reached while the normal cooling operation is being performed, the automatic vending machine transitions from the normal cooling operation to the cold-maintaining operation.

When the cold-maintaining operation is being performed, the control means 50 stop driving the compressor 4*b* via the compressor drive processing portion 54, while stopping driving the lower-side in-box blower fan F1 and the upper-side in-box blower fan F2 via the fan drive processing portion 55.

Thus air inside the commodity storage box 2 is not circulated within the box and is not cooled by the evaporator 4*a*. In this cold-maintaining operation, commodities on the lower side of the commodity-accommodating rack 10 are maintained in a cooled condition as a result of the downward flow of cold air that has been cooled by commodities on the upper side.

Figure 5:
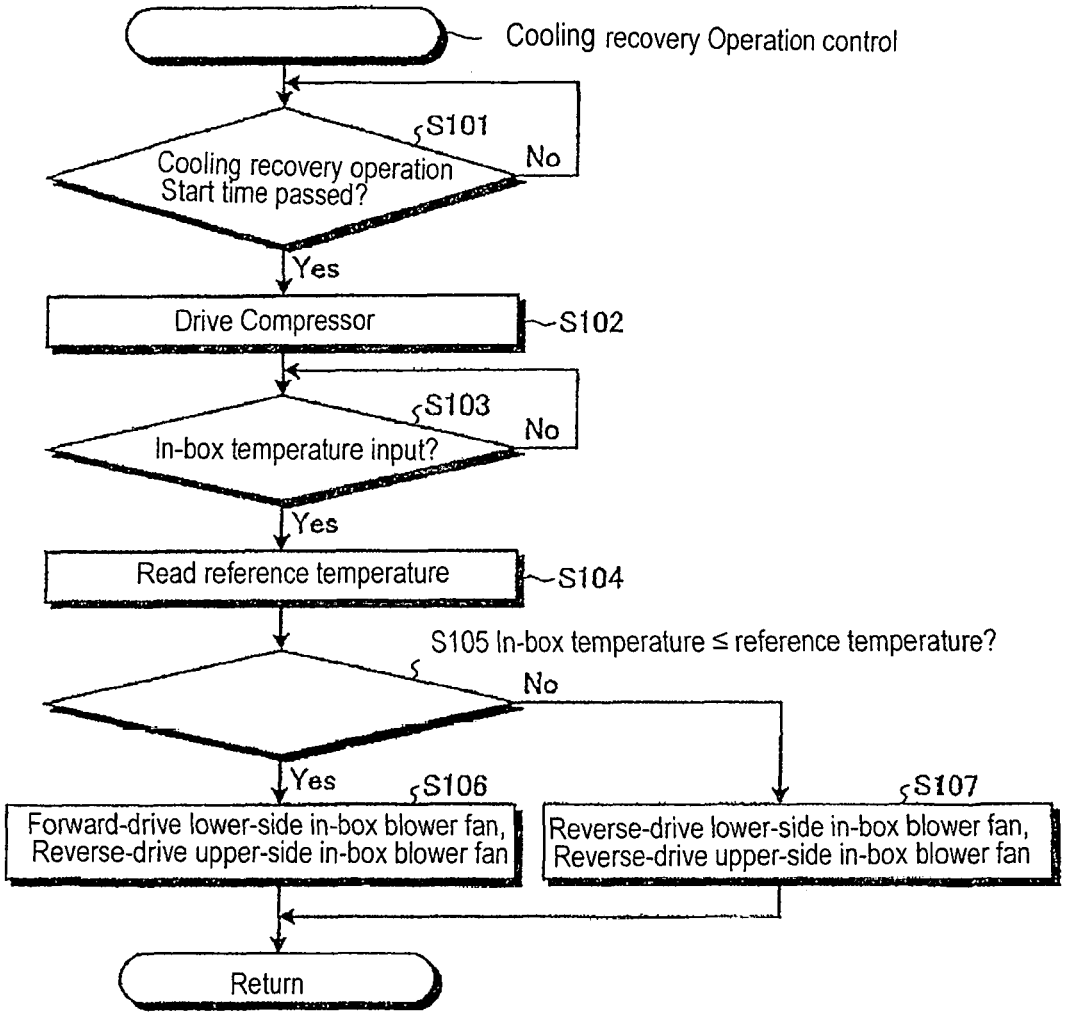
FIG. 5 is a flowchart illustrating the details of the cooling recovery operation control process executed by the control means.

FIG. 5 is a flowchart illustrating the details of the cooling recovery operation control process executed by the control means 50 discussed above. While explaining the details of said cooling recovery operation control process, an explanation will be given of a case in which the automatic vending machine is performing the cooling recovery operation.

If a preset cooling recovery operation start time is passed while the cold-maintaining operation discussed above is being performed (step S101: Yes), the control means 50 drive the compressor 4*b* via the compressor drive processing portion 54 (step S102).

Then, if an in-box temperature has been input (step S103: Yes) by input-processing, via the input-processing portion 52, a detection signal from the in-box temperature sensors S (here, assumed to be the intermediate in-box temperature sensor S3), the control means 50 read a reference temperature from the memory 60 via the determination portion 53 (step S104).

The control means 50 then determine via the determination portion 53 whether or not the in-box temperature is equal to or lower than the reference temperature (step S105), and if the in-box temperature is equal to or lower than the reference temperature (step S105: Yes) then via the fan drive processing portion 55 they forward-drive the lower-side in-box blower fan F1 and reverse-drive the upper-side in-box blower fan F2 (step S106).

Figure 6:
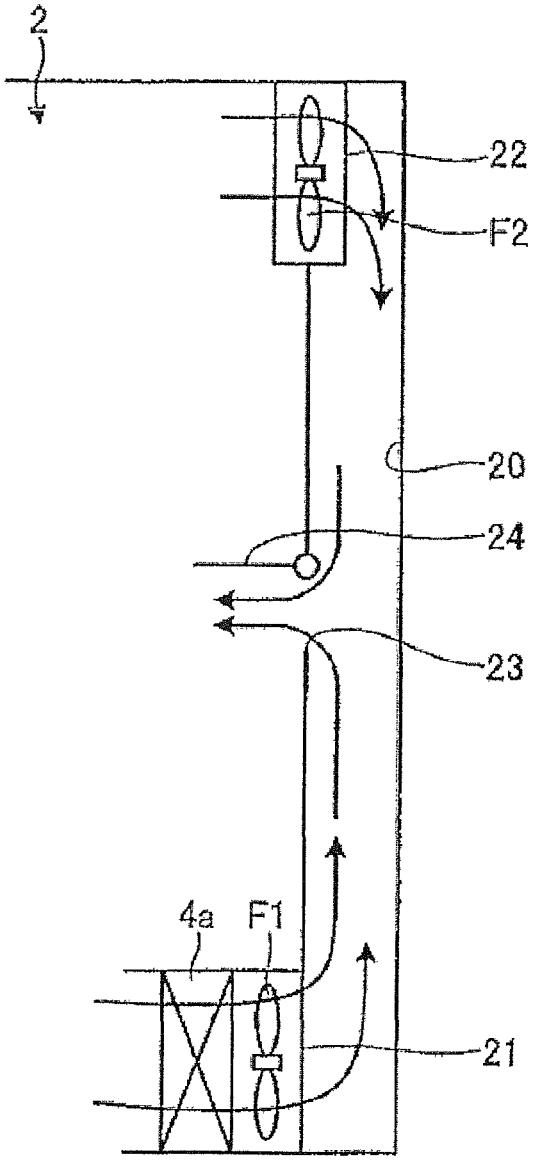
FIG. 6 is an explanatory view explaining an example of the circulation of air inside the commodity storage box when the cooling recovery operation is being performed.

By forward-driving the lower-side in-box blower fan F1 and reverse-driving the upper-side in-box blower fan F2 in this way, as illustrated in FIG. 6 air inside the commodity storage box 2 enters the interior of the rear face duct 20 through the lower-side opening 21 and enters the interior of the rear face duct 20 through the upper-side opening 22. As a result, the pressure inside the rear face duct 20 becomes larger than the pressure in the commodity storage box 2, the flapper member 24 swings forward due to said pressure differential, opening the intermediate opening 23, and internal air that has passed through the interior of the rear face duct 20 circulates, being discharged from the intermediate opening 23 and passing through commodities accommodated in the commodity-accommodating rack 10. In other words, internal air which has been cooled by the evaporator 4*a* enters through the lower-side opening 21 and passes through the rear face duct 20 after which it is discharged from the intermediate opening 23 and passes from an intermediate portion of the commodity-accommodating rack 10 through a lower region, cooling commodities accommodated in said lower region.

On the other hand, if in the abovementioned step S105 the in-box temperature exceeds the reference temperature (step S105: No), then via the fan drive processing portion 55 the lower-side in-box blower fan F1 and the upper-side in-box blower fan F2 are reverse-driven (step S107).

Figure 7:
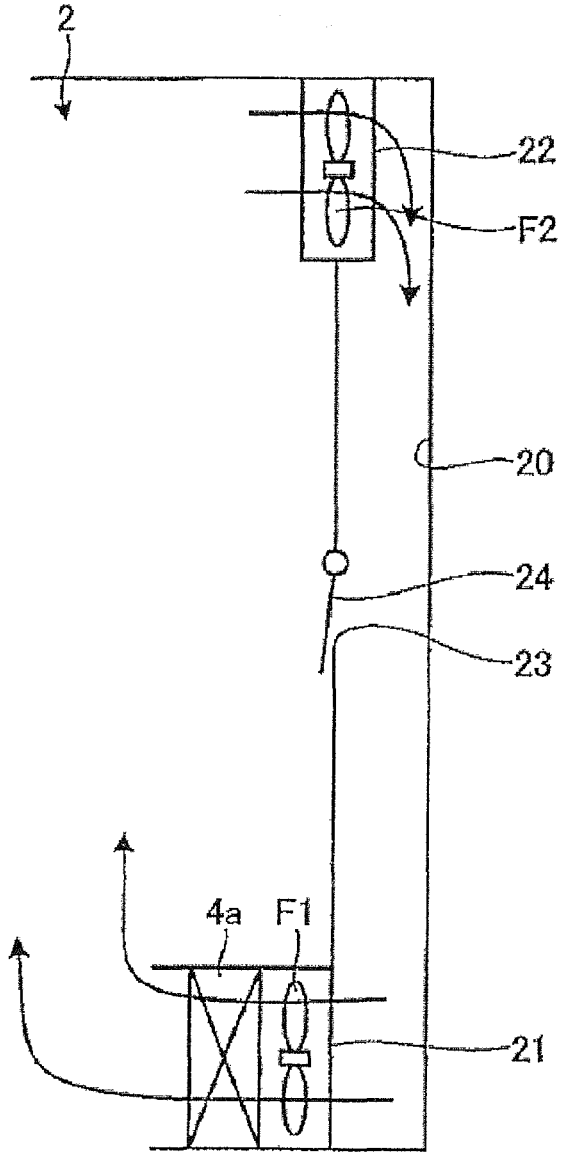
FIG. 7 is an explanatory view explaining another example of the circulation of air inside the commodity storage box when the cooling recovery operation is being performed.

By reverse-driving the lower-side in-box blower fan F1 and the upper-side in-box blower fan F2 in this way, as illustrated in FIG. 7, air inside the commodity storage box 2 enters the interior of the rear face duct 20 through the upper-side opening 22, and after having passed through the rear face duct 20 circulates, being discharged from the lower-side opening 21 and passing through commodities accommodated in the commodity-accommodating rack 10. In other words, internal air which has been cooled by the evaporator 4*a* passes through the commodity-accommodating rack 10 directly, not via the rear face duct 20, thus cooling commodities accommodated in the lower portion of said commodity-accommodating rack 10. At this time, there is not much difference between the pressure inside the rear face duct 20 and the pressure in the commodity storage box 2, and therefore the flapper member 24 closes the intermediate opening 23 by virtue of its own weight.

After the processes in the abovementioned step S106 or step S107 have been executed the procedure returns, completing the cooling recovery operation control, but when a predefined prescribed length of time has passed, or if the in-box temperature detected via the in-box temperature sensors S exceeds a preset transition temperature then the automatic vending machine transitions to the normal cooling operation discussed above and the abovementioned operation cycle is repeated.

As explained hereinabove, in the automatic vending machine being embodiment 1 of the present invention, when the normal cooling operation is being performed, the control means 50 forward-drive the lower-side in-box blower fan F1 and the upper-side in-box blower fan F2, thereby causing internal air which has been cooled by the evaporator 4*a* to circulate within the commodity storage box 2 in such a way that it enters the rear face duct 20 through the lower-side opening 21 and is discharged from the upper-side opening 22, thus cooling all of the commodities accommodated in the commodity-accommodating rack 10, and therefore even if the operation subsequently transitions to the cold-maintaining operation, commodities on the lower side of the commodity-accommodating rack 10, including the next commodity to be sold, can be cooled by means of cold air that flows downward having been cooled by means of the commodities on the upper side of said commodity-accommodating rack 10. In particular, in the automatic vending machine of the present embodiment 1 which dispenses the lowermost commodity, the uppermost commodity, which has been cooled the most, can be left to the last as a cooling source inside the commodity storage box 2, and thus the other commodities can be cooled by making effective use of said uppermost commodity. As a result, the time required for the cold-maintaining operation can be lengthened.

Further, when the cooling recovery operation is being performed, if the in-box temperature detected by means of the intermediate in-box temperature sensor S3 is equal to or less than a reference temperature, the control means 50 forward-drive the lower-side in-box blower fan F1 and reverse-drive the upper-side in-box blower fan F2, thereby causing internal air that has been cooled by the evaporator 4*a* to enter the rear face duct 20 through the lower-side opening 21 and causing internal air in the upper region of the commodity storage box 2 to enter the rear face duct 20 through the upper-side opening 22, and also causing internal air which has entered the rear face duct 20 to be discharged from the intermediate opening 23 thereby cooling commodities in the lower region from said intermediate opening 23, and therefore commodities on the lower side of the commodity-accommodating rack 10, including the next commodity to be sold, can be cooled intensively, and it is possible to prevent the commodities on the lower side from departing from the preferred cooled temperature range, and as a result loss of sales opportunities can be avoided.

Therefore, according to the automatic vending machine being the present embodiment 1, a lengthening of the commodity cold-maintaining operation time can be achieved and moreover there is no danger of commodity sales opportunities being lost.

Further, in the automatic vending machine being embodiment 1 of the present invention, when the cooling recovery operation is being performed, if the in-box temperature detected by means of the intermediate in-box temperature sensor S3 exceeds the reference temperature, the lower-side in-box blower fan F1 and the upper-side in-box blower fan F2 are reverse-driven, thereby causing internal air that has been cooled by the evaporator 4*a* and has cooled commodities accommodated in the commodity-accommodating rack 10 to circulate inside the commodity storage box 2 in such a way that it enters the rear face duct 20 through the upper-side opening 22 and is discharged from the lower-side opening 21, thereby cooling the commodities accommodated in the commodity-accommodating rack 10, and therefore the lowermost commodity, which is the next commodity to be sold, can be cooled intensively even if the temperature inside the commodity storage box 2 has risen more than necessary because a large number of commodities were sold while the cold-maintaining operation was being performed, or because the time required for the cold-maintaining operation was extended. It is therefore possible to prevent said lowermost commodity from departing from the preferred cooled temperature range, and as a result loss of sales opportunities can be avoided.

According to the abovementioned automatic vending machine, the flapper member 24 in a normal condition closes the intermediate opening 23 by means of its own weight, whereas if the pressure inside the rear face duct 20 is greater than the pressure in the commodity storage box 2 it swings, opening the abovementioned intermediate opening 23, and therefore if the lower-side in-box blower fan F1 and the upper-side in-box blower fan F2 are being forward-driven, as when the normal cooling operation is being performed, or if the lower-side in-box blower fan F1 and the upper-side in-box blower fan F2 are being reverse-driven, as when the cooling recovery operation is being performed, it is possible to prevent internal air which is passing through the rear face duct 20 from being discharged from the intermediate opening 23, and commodities accommodated in the commodity storage box 2 can be cooled satisfactorily.

According to the abovementioned automatic vending machine, the lower-side in-box blower fan F1 is provided to the front of the lower-side opening 21, and the upper-side in-box blower fan F2 is provided to the front of the upper-side opening 22, thereby allowing internal air to be circulated efficiently, and the cooling efficiency can thus be improved.

Embodiment 2

Figure 8:
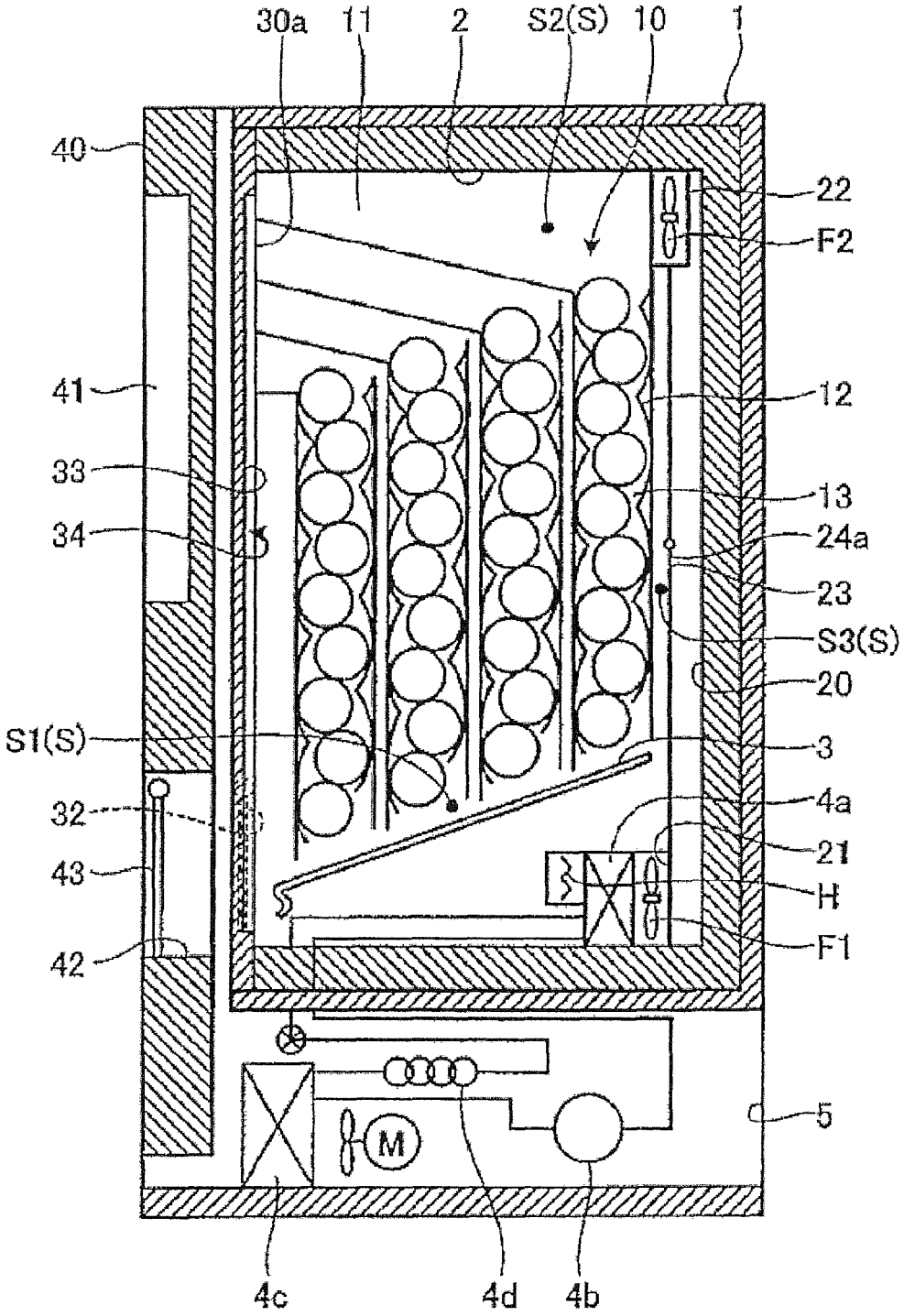
FIG. 8 is a cross-sectional side view illustrating an automatic vending machine, being embodiment 2 of the present invention.

FIG. 8 is a cross-sectional side view illustrating an automatic vending machine, being embodiment 2 of the present invention. It should be noted that constituents that are the same as in the automatic vending machine being embodiment 1 discussed hereinabove are explained using the same reference numbers. The automatic vending machine shown here by way of example sells commodities such as beverages in cans or beverages in PET bottles in a cooled or heated state, and is provided with a main body cabinet 1, which is the automatic vending machine main body.

The main body cabinet 1 is configured by suitably combining a plurality of metal plates, and is configured in the shape of a rectangular cuboid the front face of which is open. A commodity storage box 2 having a thermally insulating construction the front face of which is open is provided inside the main body cabinet 1. In the present embodiment 2 the commodity storage box 2 is configured in a space enclosed by thermally insulating boards formed in advance into the shape of plates, by disposing the thermally insulating boards on the inner surfaces of the main body cabinet 1. The thermally insulating boards are not indicated specifically in the drawings, but they comprise plate-shaped members formed from a thermally insulating material such as urethane foam to the front and rear surfaces of which resin film or kraft paper are bonded as a surface material.

A commodity-accommodating rack 10, being a commodity-accommodating device, is disposed in the commodity storage box 2. In the commodity-accommodating rack 10, a serpentine commodity-accommodating region 13 extending vertically is configured by disposing passage-forming members 12 between a pair of side plates 11, and it accommodates commodities in the commodity-accommodating region 13 and on the other hand dispenses commodities starting with that in the lowermost position when it receives a commodity sell command. A plurality of commodity-accommodating racks 10 having commodity-accommodating regions 13 is disposed front to rear in the present embodiment 2.

Further, a commodity shooter 3 and a rear face duct 20 are provided in the commodity storage box 2. The commodity shooter 3 is provided in the lower region of the commodity-accommodating rack 10. The commodity shooter 3 is a flat plate-shaped member having multiple ventilation holes, and is disposed obliquely in a manner such that it becomes gradually lower from the rear toward the front of the commodity storage box 2.

The rear face duct 20 is an air-guiding passage provided on the rear face of the commodity storage box 2. The rear face duct 20 extends vertically, its uppermost portion being positioned higher than the commodities accommodated in the commodity-accommodating rack 10.

In the rear face duct 20, a lower-side opening 21 is provided in a position that is lower than the commodity shooter 3, and an upper-side opening 22 is provided in a position that is higher than the commodities accommodated in the commodity-accommodating rack 10.

Also, in the rear face duct 20 a lower-side in-box blower fan F1 is provided to the front of the lower-side opening 21, and an upper-side in-box blower fan F2 is provided to the front of the upper-side opening 22. The lower-side in-box blower fan F1 and the upper-side in-box blower fan F2 are circulation means which circulate internal air (internal atmosphere) in the commodity storage box 2 by being forward-driven or reverse-driven in accordance with drive commands from control means 70 discussed hereinbelow. Here, when the lower-side in-box blower fan F1 is forward-driven, internal air is emitted from the lower-side opening 21 into the rear face duct 20, whereas when it is reverse-driven, air inside the rear face duct 20 is emitted forward through the lower-side opening 21. When the upper-side in-box blower fan F2 is forward-driven, air inside the rear face duct 20 is emitted forward through the upper-side opening 22, whereas when it is reverse-driven, internal air is emitted from the upper-side opening 22 into the rear face duct 20.

Moreover, an intermediate opening 23 is provided in the rear face duct 20 at a height level corresponding to a commodity several items up from the lowermost commodity accommodated in the commodity-accommodating rack 10, between the lower-side opening 21 and the upper-side opening 22. The intermediate opening 23 is opened and closed by means of a flapper member 24*a*. More specifically, the flapper member 24*a* is provided in such a way that it can swing in a manner whereby it opens and closes the intermediate opening 23, and in a normal condition it closes the intermediate opening 23 by means of its own weight, and if the pressure inside the rear face duct 20 is greater than the pressure in the commodity storage box 2 it swings forward, opening the intermediate opening 23, whereas if the pressure inside the rear face duct 20 is smaller than the pressure in the commodity storage box 2 it swings backward, opening the intermediate opening 23.

An evaporator 4*a* and a heater H are provided to the front of the lower-side in-box blower fan F1 in the lower region of the abovementioned commodity shooter 3. The evaporator 4*a* is disposed to the front of the lower-side in-box blower fan F1, being cooling means which, together with a compressor 4*b*, a condenser 4*c* and an expansion mechanism 4*d* installed in a machine chamber 5 below the commodity storage box 2, constitute a cooling unit. The heater H is disposed to the front of the evaporator 4*a*, and comprises heating means which generate heat when in an energized state.

On the other hand, the abovementioned automatic vending machine is provided with an external door 40 and an internal door 30*a*, being a door body. The purpose of the internal door 30*a* is to cover the front face opening of the commodity storage box 2, and it has a thermally insulating construction and is disposed at one side edge of the main body cabinet 1 such that it can open and close. A commodity-unloading port which is not shown in the drawings is provided in the internal door 30*a*. The commodity-unloading port is opened and closed by means of a commodity-unloading door 32. Further, recessed portions 33 which extend vertically are provided in the internal door 30*a* in regions at both sides of the commodity-unloading port. Said recessed portions 33 form ventilation passages 34 between the internal door 30*a* and the commodity-accommodating rack 10.

The purpose of the external door 40 is to cover the front face opening of the main body cabinet 1, and it is disposed at one side edge of the main body cabinet 1 such that it can open and close, in a position to the front of the internal door 30*a*. A display window 41 and a commodity removal port 42, which are required for a commodity to be sold, are provided in the front face of the external door 40, and although not illustrated specifically in the drawings, a commodity selection button, a banknote insertion port, a coin slot, a return lever, a monetary amount indicator, a coin return port and the like are also provided. Here, the commodity removal port 42 is opened and closed by means of a commodity removal door 43.

Figure 9:
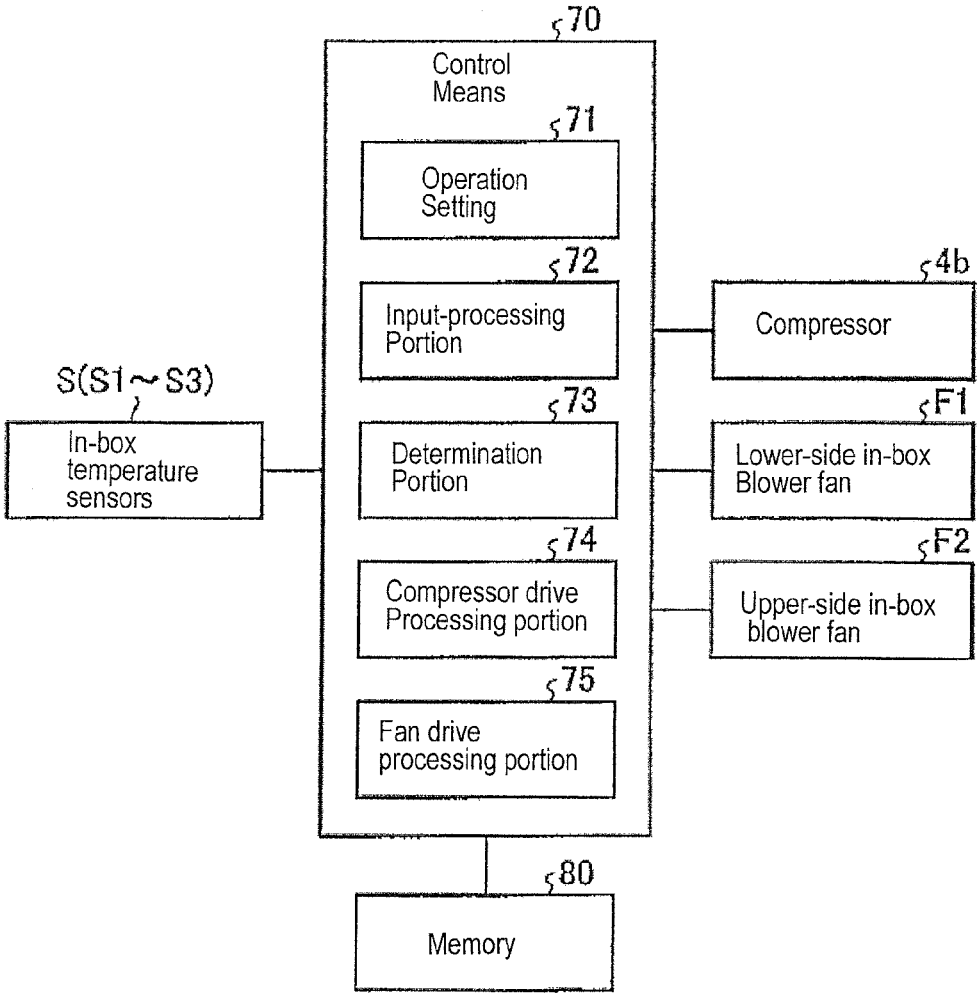
FIG. 9 is a block diagram illustrating schematically a characteristic control system of an automatic vending machine being embodiment 2 of the present invention.

FIG. 9 is a block diagram illustrating schematically a characteristic control system of the automatic vending machine being embodiment 2 of the present invention. As illustrated in FIG. 9, the automatic vending machine of the present embodiment 2 has in-box temperature sensors S and control means 70.

The in-box temperature sensors S detect the temperature inside the commodity storage box 2, and in the present embodiment 2 three temperature sensors are provided, namely a lower in-box temperature sensor S1, an upper in-box temperature sensor S2 and an intermediate in-box temperature sensor S3. The lower in-box temperature sensor S1 is provided in a lower portion of the commodity-accommodating rack 10, and the upper in-box temperature sensor S2 is provided in an upper portion of the commodity-accommodating rack 10. The intermediate in-box temperature sensor S3 is provided at a height level corresponding to the intermediate opening 23 of the rear face duct 20. When the in-box temperature sensors S have detected the in-box temperature they send this fact to the control means 70 as a detection signal.

The control means 70 control the driving of the compressor 4*b*, the lower-side in-box blower fan F1 and the upper-side in-box blower fan F2 in accordance with data and a program stored in advance in memory 80, and consist of an operation setting portion 71, an input-processing portion 72, a determination portion 73, a compressor drive processing portion 74 and a fan drive processing portion 75. It should be noted that the control means 70 may be configured integrally with a control portion which controls cash processing and selling actions in the automatic vending machine, or may be configured in a form that is independent from said control portion.

The operation setting portion 71 sets and stores operating information input via input means which are not shown in the drawings. More specifically, if a preset normal cooling operation start time is passed, it causes the normal cooling operation to be performed, and if a preset cold-maintaining operation start time is passed while said normal cooling operation is being performed, it causes the cold-maintaining operation to be performed. Further, if a preset cooling recovery operation start time is passed while the cold-maintaining operation is being performed, it causes the cooling recovery operation to be performed. In other words, it causes the automatic vending machine to perform and repeat the operations normal cooling operation→cold-maintaining operation→cooling recovery operation in accordance with a preset time schedule. It should be noted that when commodity replenishment or the like has been performed, a pull-down operation is performed for a prescribed time, after which operation transitions to the normal cooling operation.

The input-processing portion 72 input-processes detection signals provided by the in-box temperature sensors S. When the normal cooling operation or the cooling recovery operation is being performed, the determination portion 73 makes a determination by comparing the in-box temperature which has been input-processed by the input-processing portion 72 with a judgment temperature or a reference temperature (threshold) read from the memory 80. More specifically, when the normal cooling operation is being performed, the determination portion 73 determines the commodity accommodation condition in the commodity-accommodating rack 10 in the commodity storage box 2 by comparing the upper in-box temperature, which has been detected by the upper in-box temperature sensor S2 and has been input-processed by the input-processing portion 72, with a judgment temperature read from the memory 80. In other words, if the upper in-box temperature is equal to or greater than the judgment temperature the determination portion 73 determines that a large number of commodities are accommodated in the commodity-accommodating rack 10, and if the upper in-box temperature is less than the judgment temperature it determines that a small number of commodities are accommodated in the commodity-accommodating rack 10.

Further, when the cooling recovery operation is being performed, the determination portion 73 determines the in-box temperature condition in the commodity storage box 2 by comparing the intermediate in-box temperature which has been detected by the intermediate in-box temperature sensor S3 and has been input-processed by the input-processing portion 72 with a reference temperature read from the memory 80.

The compressor drive processing portion 74 performs drive processing of the compressor 4*b* by providing the compressor 4*b* with a drive command or a drive stop command. The fan drive processing portion 75 performs drive processing of the lower-side in-box blower fan F1 by providing the lower-side in-box blower fan F1 with a forward-drive command, a reverse-drive command or a drive stop command, and it performs drive processing of the upper-side in-box blower fan F2 by providing the upper-side in-box blower fan F2 with a forward-drive command, a reverse-drive command or a drive stop command.

In an automatic vending machine having the configuration described hereinabove, commodities accommodated in the commodity-accommodating rack 10 are cooled as follows.

Figure 10:
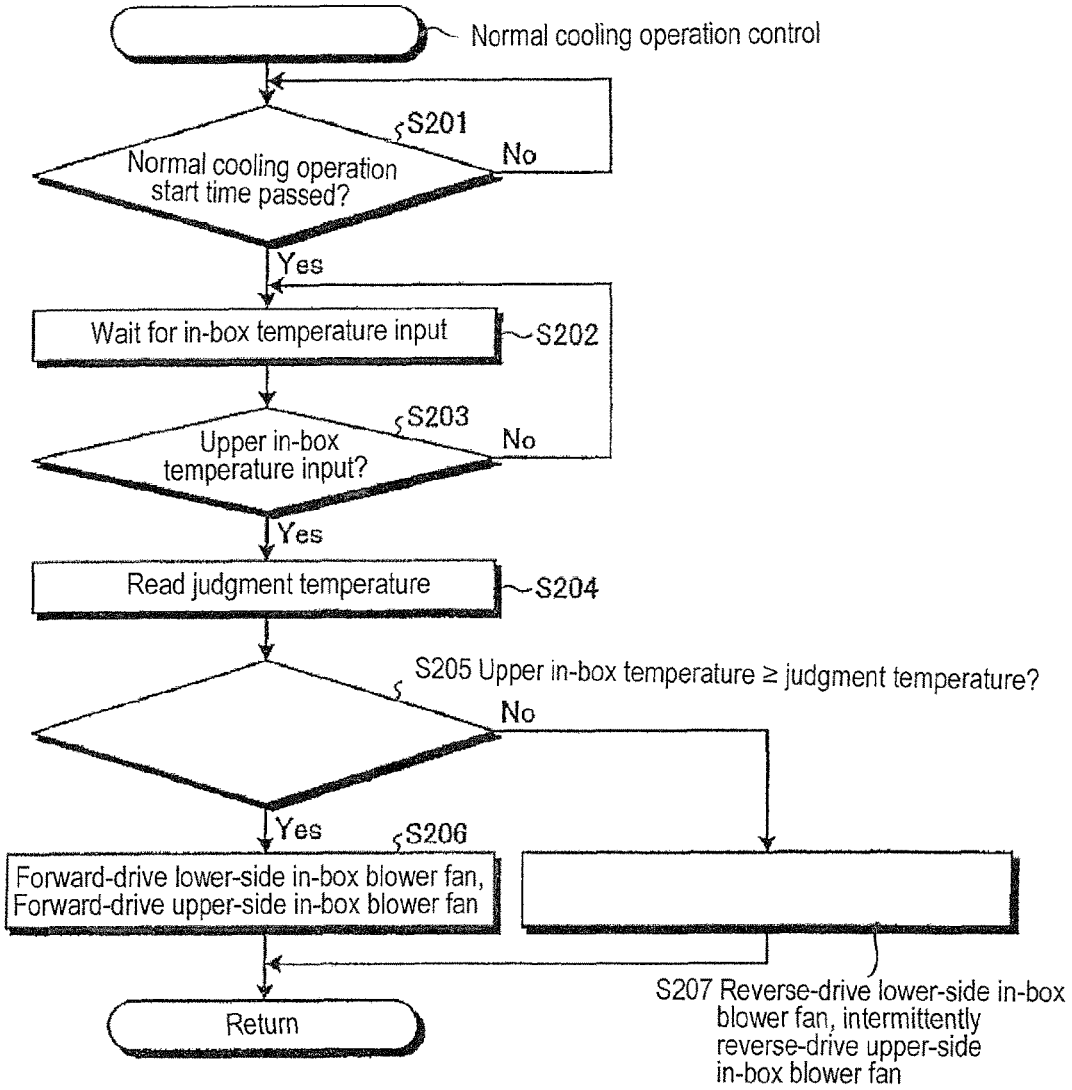
FIG. 10 is a flowchart illustrating the details of the normal cooling operation control process executed by the control means.

An explanation will first be given of a case in which the normal cooling operation is being performed. FIG. 10 is a flowchart illustrating the details of the normal cooling operation control process executed by the control means 70 discussed above. While explaining the details of said normal cooling operation control process, an explanation will be given of a case in which the automatic vending machine is performing the normal cooling operation.

If a preset normal cooling operation start time is passed while the cooling recovery operation discussed above is being performed (step S201: Yes), the control means 70 wait for input of a detection signal from the in-box temperature sensors S (upper in-box temperature sensor S2) (step S202). It should be noted that the compressor 4*b* is always in a driven state in the cooling recovery operation.

If the upper in-box temperature has been input by input-processing, via the input-processing portion 72, a detection signal from the in-box temperature sensors S (upper in-box temperature sensor S2) (step S203: Yes), the control means 70 read a judgment temperature from the memory 80 via the determination portion 73 (step S204).

The control means 70 then determine via the determination portion 73 whether or not the upper in-box temperature is equal to or greater than the judgment temperature (step S205), and if the upper in-box temperature is equal to or greater than the judgment temperature (step S205: Yes), in other words if it is determined via the determination portion 73 that a large number of commodities are accommodated in the commodity-accommodating rack 10, then the lower-side in-box blower fan F1 is forward-driven and the upper-side in-box blower fan F2 is forward-driven (step S206) via the fan drive processing portion 75.

Figure 11:
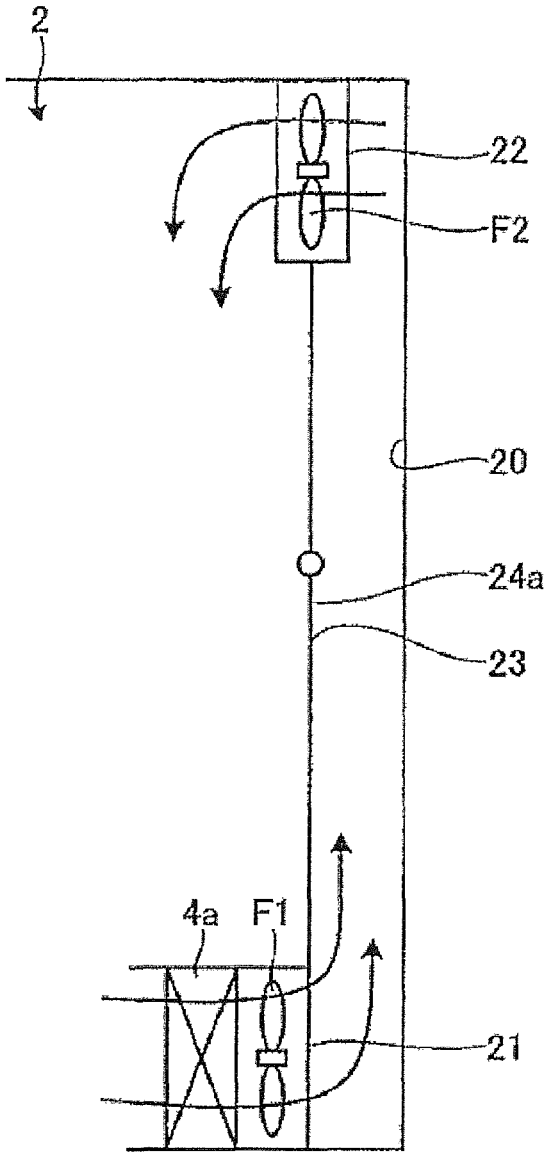
FIG. 11 is an explanatory view explaining an example of the circulation of air inside the commodity storage box when the normal cooling operation is being performed.

By forward-driving the lower-side in-box blower fan F1 and forward-driving the upper-side in-box blower fan F2 in this way, as illustrated in FIG. 11, air inside the commodity storage box 2 enters the interior of the rear face duct 20 through the lower-side opening 21, and after having passed through the rear face duct 20 it circulates, being discharged from the upper-side opening 22 and passing through commodities accommodated in the commodity-accommodating rack 10. In other words, internal air which has been cooled by the evaporator 4*a* passes through the rear face duct 20 after which it is discharged from the upper-side opening 22 and passes through the commodity-accommodating rack 10, cooling commodities accommodated in said commodity-accommodating rack 10. At this time, there is not much difference between the pressure inside the rear face duct 20 and the pressure in the commodity storage box 2, and therefore the flapper member 24*a* closes the intermediate opening 23 by virtue of its own weight. By this means, all of the commodities accommodated in the commodity-accommodating rack 10 are cooled to a desired temperature condition, commodities on the upper side being cooled more than commodities on the lower side.

Figure 12:
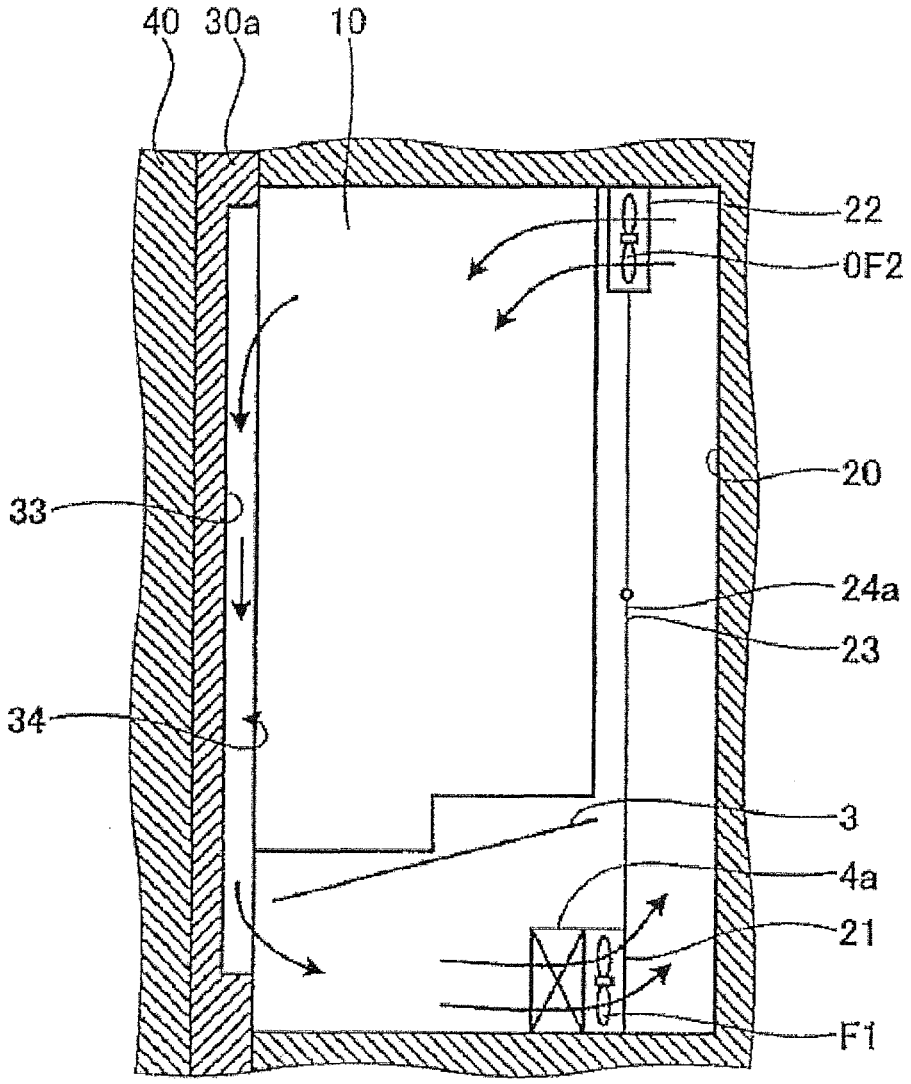
FIG. 12 is a cross-sectional side view of the commodity storage box explaining an example of the circulation of air inside the commodity storage box when the normal cooling operation is being performed.

Further, ventilation passages 34 are formed between the internal door 30*a* and the commodity-accommodating rack 10 by providing recessed portions 33 in the internal door 30*a*, and thus as illustrated in FIG. 12, a portion of the air discharged from the upper-side opening 22 can pass through the ventilation passages 34. By passing a portion of the air discharged from the upper-side opening 22 through the ventilation passages 34 in this way cooled air which has passed through the rear face duct 20 and has been discharged can also be actively supplied to the front of the commodity-accommodating rack 10, and all of the commodities accommodated in the commodity-accommodating rack 10 can be cooled satisfactorily.

On the other hand, if in the abovementioned step S205 the upper in-box temperature is less than the judgment temperature (S205: No), in other words if it is determined via the determination portion 73 that a small number of commodities are accommodated in the commodity-accommodating rack 10, then via the fan drive processing portion 75 the control means 70 reverse-drive the lower-side in-box blower fan F1 and intermittently reverse-drive the upper-side in-box blower fan F2 in such a way that its blowing rate is lower than that of the lower-side in-box blower fan F1 (step S207).

Figure 13:
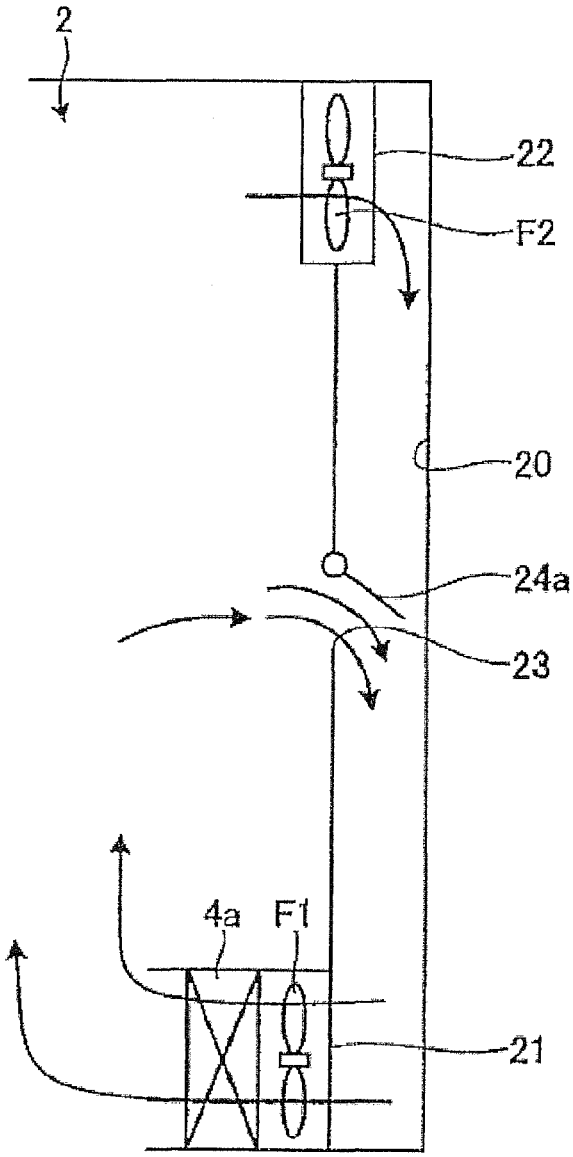
FIG. 13 is an explanatory view explaining an example of the circulation of air inside the commodity storage box when the normal cooling operation is being performed.

By reverse-driving the lower-side in-box blower fan F1 and intermittently reverse-driving the upper-side in-box blower fan F2 in this way, the pressure differential between the rear face duct 20 and the commodity storage box 2 in the vicinity of the upper-side opening 22 becomes smaller, but the pressure differential between the rear face duct 20 and the commodity storage box 2 in the vicinity of the intermediate opening 23 becomes larger, and the flapper member 24*a* is caused to swing forward by means of this pressure differential, opening the intermediate opening 23. By this means, as illustrated in FIG. 13, air inside the commodity storage box 2 enters the interior of the rear face duct 20, more air entering through the intermediate opening 23 than through the upper-side opening 22, and after having passed through the rear face duct 20 it circulates, being discharged from the lower-side opening 21 and passing through commodities accommodated in the commodity-accommodating rack 10. In other words, internal air which has been cooled by the evaporator 4*a* passes through the commodity-accommodating rack 10 directly, not via the rear face duct 20, thus cooling commodities accommodated in said commodity-accommodating rack 10, and moreover very little passes through the upper region of the commodity-accommodating rack 10 in which there are no commodities, and therefore commodities accommodated in the lower region of the commodity-accommodating rack 10 can be cooled intensively.

Figure 14:
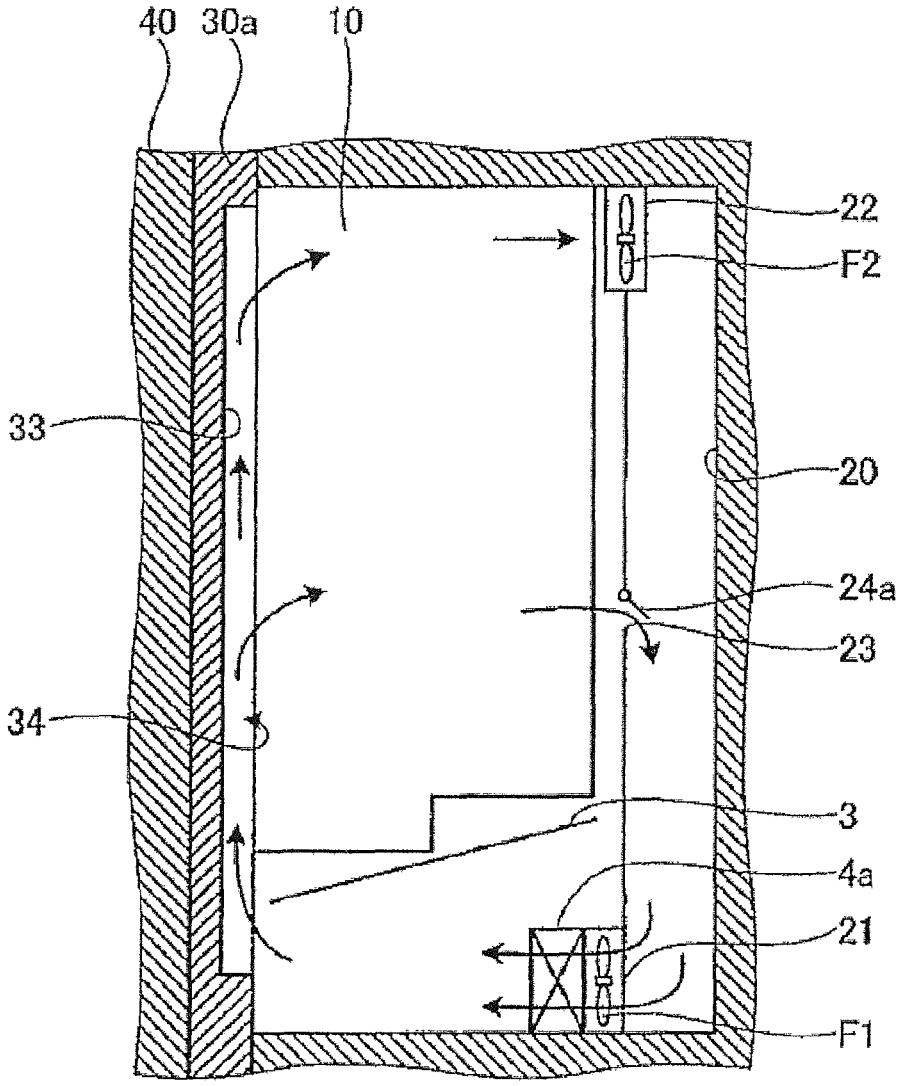
FIG. 14 is a cross-sectional side view of the commodity storage box explaining an example of the circulation of air inside the commodity storage box when the normal cooling operation is being performed.

Further, also when internal air is circulated in this way, as illustrated in FIG. 14 a portion of the air discharged from the lower-side opening 21 can pass through the ventilation passages 34. By passing a portion of the air discharged from the lower-side opening 21 through the ventilation passages 34 in this way cooled air can also be actively supplied to the front of the commodity-accommodating rack 10, and all of the commodities accommodated in the commodity-accommodating rack 10 can be cooled satisfactorily.

After the processes in the abovementioned step S206 or step S207 have been executed the procedure returns, completing the normal cooling operation control, but if a predefined cold-maintaining operation start time is reached while this normal cooling operation is being performed, the automatic vending machine transitions from the normal cooling operation to the cold-maintaining operation.

When the cold-maintaining operation is being performed, the control means 70 stop driving the compressor 4*b* via the compressor drive processing portion 74, while stopping driving the lower-side in-box blower fan F1 and the upper-side in-box blower fan F2 via the fan drive processing portion 75.

Thus air inside the commodity storage box 2 is not circulated within the box and is not cooled by the evaporator 4*a*. In this cold-maintaining operation, commodities on the lower side of the commodity-accommodating rack 10 are maintained in a cooled condition as a result of the downward flow of cold air that has been cooled by commodities on the upper side.

Figure 15:
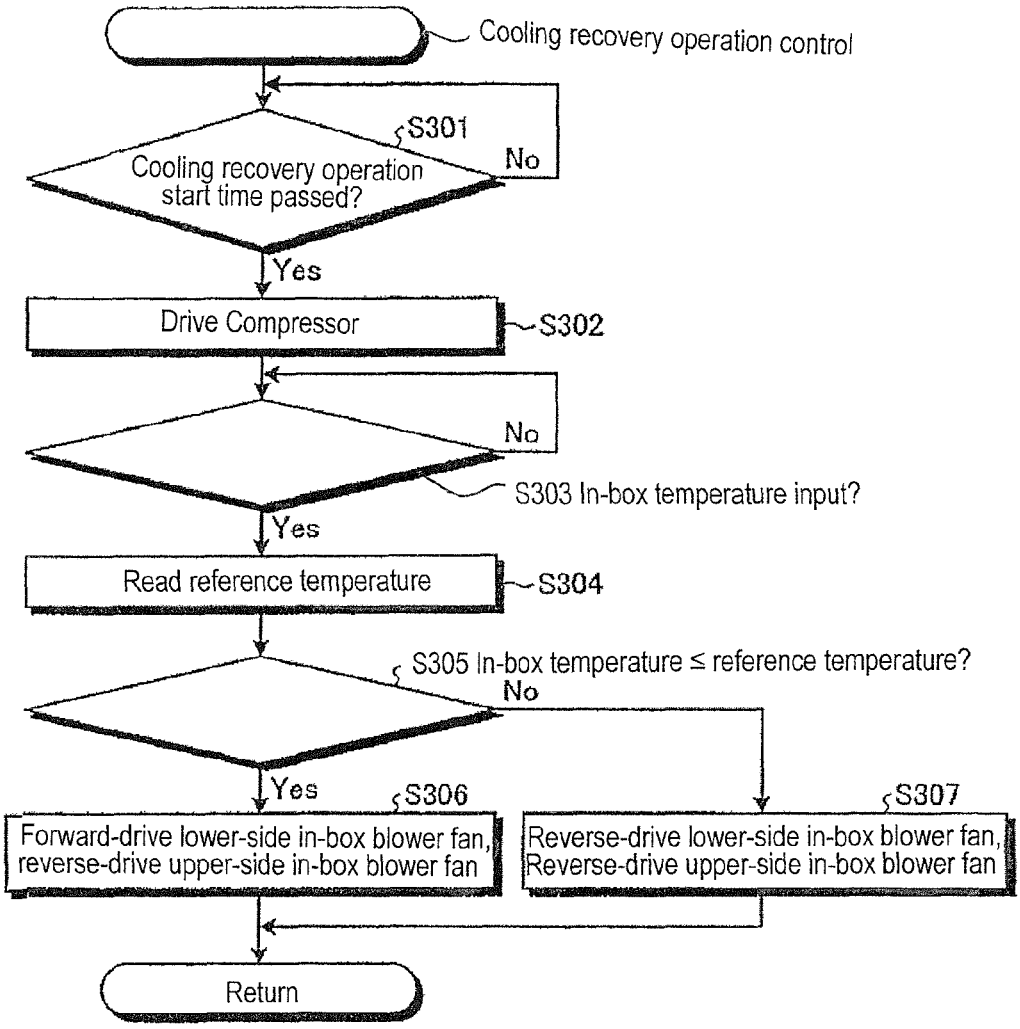
FIG. 15 is a flowchart illustrating the details of the cooling recovery operation control process executed by the control means.

FIG. 15 is a flowchart illustrating the details of the cooling recovery operation control process executed by the control means 70 discussed above. While explaining the details of said cooling recovery operation control process, an explanation will be given of a case in which the automatic vending machine is performing the cooling recovery operation.

If a preset cooling recovery operation start time is passed while the cold-maintaining operation discussed above is being performed (step S301: Yes), the control means 70 drive the compressor 4*b* via the compressor drive processing portion 74 (step S302).

Then, if an in-box temperature has been input (step S303: Yes) by input-processing, via the input-processing portion 72, a detection signal from the in-box temperature sensors S (intermediate in-box temperature sensor S3), the control means 70 read a reference temperature from the memory 80 via the determination portion 73 (step S304).

The control means 70 then determine via the determination portion 73 whether or not the in-box temperature is equal to or lower than the reference temperature (step S305), and if the in-box temperature is equal to or lower than the reference temperature (step S305: Yes) then via the fan drive processing portion 75 they forward-drive the lower-side in-box blower fan F1 and reverse-drive the upper-side in-box blower fan F2 (step S306).

Figure 16:
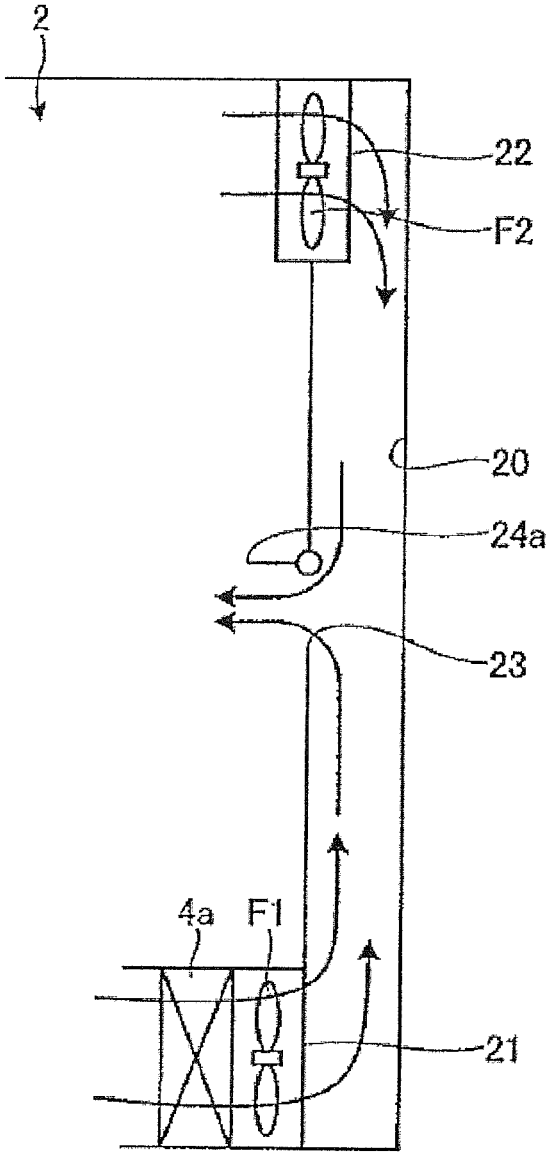
FIG. 16 is an explanatory view explaining an example of the circulation of air inside the commodity storage box when the cooling recovery operation is being performed.

By forward-driving the lower-side in-box blower fan F1 and reverse-driving the upper-side in-box blower fan F2 in this way, as illustrated in FIG. 16 air inside the commodity storage box 2 enters the interior of the rear face duct 20 through the lower-side opening 21 and enters the interior of the rear face duct 20 through the upper-side opening 22. As a result, the pressure inside the rear face duct 20 becomes larger than the pressure in the commodity storage box 2, the flapper member 24*a* swings forward due to said pressure differential, opening the intermediate opening 23, and internal air that has passed through the interior of the rear face duct 20 circulates, being discharged from the intermediate opening 23 and passing through commodities accommodated in the commodity-accommodating rack 10. In other words, internal air which has been cooled by the evaporator 4*a* enters through the lower-side opening 21 and passes through the rear face duct 20 after which it is discharged from the intermediate opening 23 and passes from an intermediate portion of the commodity-accommodating rack 10 through a lower region, cooling commodities accommodated in said lower region.

Further, also when internal air is circulated in this way, a portion of the air discharged from the intermediate opening 23 can pass through the ventilation passages 34, although this is not illustrated specifically in the drawings. By passing a portion of the air discharged from the intermediate opening 23 through the ventilation passages 34 in this way cooled air can also be actively supplied to the front of the commodity-accommodating rack 10, and all of the commodities accommodated in the commodity-accommodating rack 10 can be cooled satisfactorily.

On the other hand, if in the abovementioned step S305 the in-box temperature exceeds the reference temperature (step S305: No), then via the fan drive processing portion 75 the lower-side in-box blower fan F1 and the upper-side in-box blower fan F2 are reverse-driven (step S307).

Figure 17:
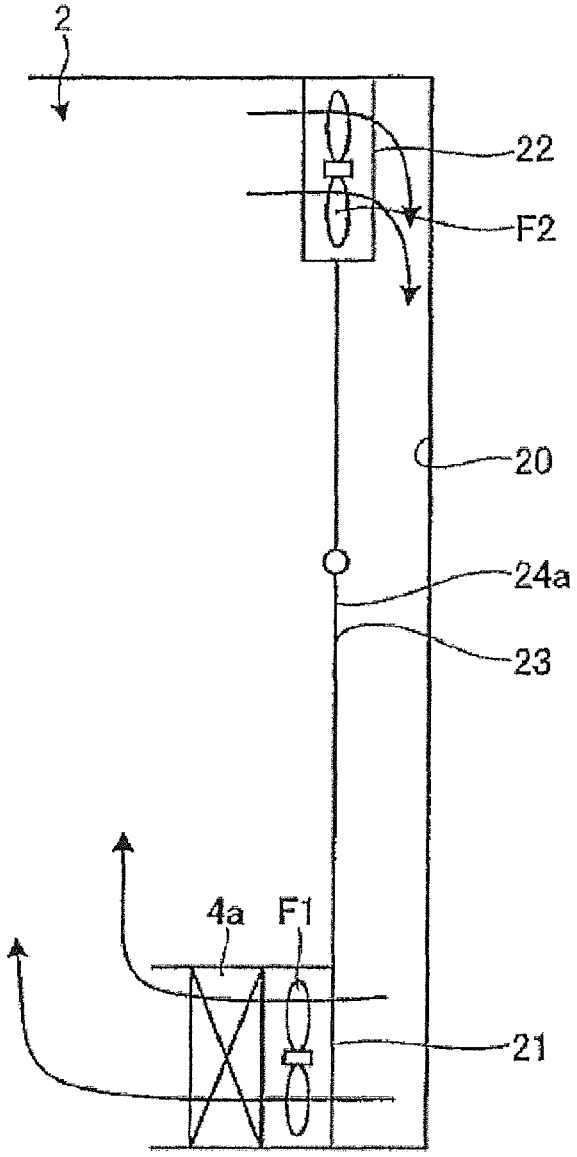
FIG. 17 is an explanatory view explaining another example of the circulation of air inside the commodity storage box when the cooling recovery operation is being performed.

By reverse-driving the lower-side in-box blower fan F1 and the upper-side in-box blower fan F2 in this way, as illustrated in FIG. 17, air inside the commodity storage box 2 enters the interior of the rear face duct 20 through the upper-side opening 22, and after having passed through the rear face duct 20 it circulates, being discharged from the lower-side opening 21 and passing through commodities accommodated in the commodity-accommodating rack 10. In other words, internal air which has been cooled by the evaporator 4*a* passes through the commodity-accommodating rack 10 directly, not via the rear face duct 20, thus cooling commodities accommodated in the lower portion of said commodity-accommodating rack 10. At this time, there is not much difference between the pressure inside the rear face duct 20 and the pressure in the commodity storage box 2, and therefore the flapper member 24*a* closes the intermediate opening 23 by virtue of its own weight.

Further, also when internal air is circulated in this way, a portion of the air discharged from the lower-side opening 21 can pass through the ventilation passages 34, although this is not illustrated specifically in the drawings. By passing a portion of the air discharged from the lower-side opening 21 through the ventilation passages 34 in this way cooled air can also be actively supplied to the front of the commodity-accommodating rack 10, and all of the commodities accommodated in the commodity-accommodating rack 10 can be cooled satisfactorily.

After the processes in the abovementioned step S306 or step S307 have been executed the procedure returns, completing the cooling recovery operation control, but when a predefined prescribed length of time has passed, or if the in-box temperature detected via the in-box temperature sensors S exceeds a preset transition temperature then the automatic vending machine transitions to the normal cooling operation discussed above and the abovementioned operation cycle is repeated.

As explained hereinabove, in the automatic vending machine being embodiment 2 of the present invention, when the normal cooling operation is being performed, the control means 70 forward-drive the lower-side in-box blower fan F1 and the upper-side in-box blower fan F2 if they have determined that a large number of commodities are accommodated in the commodity-accommodating rack 10, thereby causing internal air which has been cooled by the evaporator 4*a* to circulate within the commodity storage box 2 in such a way that it enters the rear face duct 20 through the lower-side opening 21 and is discharged from the upper-side opening 22, thus cooling all of the commodities accommodated in the commodity-accommodating rack 10, and therefore even if the operation subsequently transitions to the cold-maintaining operation, commodities on the lower side of the commodity-accommodating rack 10, including the next commodity to be sold, can be cooled by means of cold air that flows downward having been cooled by means of the commodities on the upper side of said commodity-accommodating rack 10. In particular, in the automatic vending machine of the present embodiment 2 which dispenses the lowermost commodity, the uppermost commodity, which has been cooled the most, can be left to the last as a cooling source inside the commodity storage box 2, and thus the other commodities can be cooled by making effective use of said uppermost commodity. As a result, the time required for the cold-maintaining operation can be lengthened.

Further, in the abovementioned automatic vending machine, when the abovementioned normal cooling operation is being performed, the control means 70 reverse-drive the lower-side in-box blower fan F1 and intermittently reverse-drive the upper-side in-box blower fan F2 if they have determined that a small number of commodities are accommodated in the commodity-accommodating rack 10, and thus internal air which has been cooled by the evaporator 4*a* can be actively caused to pass through the lower region of the commodity-accommodating rack 10, with very little passing through the upper region of the commodity-accommodating rack 10 in which there are no commodities, and by this means commodities accommodated in the lower region of the commodity-accommodating rack 10 can be intensively cooled. Further, by performing this normal cooling operation, even if the operation subsequently transitions to the cold-maintaining operation, commodities on the lower side of the commodity-accommodating rack 10, including the next commodity to be sold, can be cooled by means of cold air that flows downward having been cooled by means of the commodities on the upper side thereof. In particular, in the automatic vending machine of the present embodiment 2 which dispenses the lowermost commodity, the commodities on the upper side, which have been cooled the most, can be left to the last as a cooling source inside the commodity storage box 2, and thus the other commodities can be cooled by making effective use of these commodities on the upper side. As a result, the time required for the cold-maintaining operation can be lengthened.

Then, in the abovementioned automatic vending machine, when the cooling recovery operation is being performed, if the in-box temperature detected by means of the intermediate in-box temperature sensor S3 is equal to or less than a reference temperature, the control means 70 forward-drive the lower-side in-box blower fan F1 and reverse-drive the upper-side in-box blower fan F2, thereby causing internal air that has been cooled by the evaporator 4*a* to enter the rear face duct 20 through the lower-side opening 21 and causing internal air in the upper region of the commodity storage box 2 to enter the rear face duct 20 through the upper-side opening 22, and also causing internal air which has entered the rear face duct 20 to be discharged from the intermediate opening 23 thereby cooling commodities in the lower region from said intermediate opening 23, and therefore commodities on the lower side of the commodity-accommodating rack 10, including the next commodity to be sold, can be cooled intensively, and it is possible to prevent the commodities on the lower side from departing from the preferred cooled temperature range, and as a result loss of sales opportunities can be avoided.

Therefore, according to the automatic vending machine being the present embodiment 2, a lengthening of the commodity cold-maintaining operation time can be achieved and moreover there is no danger of commodity sales opportunities being lost.

Further, in the automatic vending machine being embodiment 2 of the present invention, when the cooling recovery operation is being performed, if the in-box temperature detected by means of the intermediate in-box temperature sensor S3 exceeds the reference temperature, the lower-side in-box blower fan F1 and the upper-side in-box blower fan F2 are reverse-driven, thereby causing internal air that has been cooled by the evaporator 4*a* and has cooled commodities accommodated in the commodity-accommodating rack 10 to circulate inside the commodity storage box 2 in such a way that it enters the rear face duct 20 through the upper-side opening 22 and is discharged from the lower-side opening 21, thereby cooling the commodities accommodated in the commodity-accommodating rack 10, and therefore the lowermost commodity, which is the next commodity to be sold, can be cooled intensively even if the temperature inside the commodity storage box 2 has risen more than necessary because a large number of commodities were sold while the cold-maintaining operation was being performed, or because the time required for the cold-maintaining operation was extended. It is therefore possible to prevent said lowermost commodity from departing from the preferred cooled temperature range, and as a result loss of sales opportunities can be avoided.

According to the abovementioned automatic vending machine, the flapper member 24*a* in a normal condition closes the intermediate opening 23 by means of its own weight, and if the pressure inside the rear face duct 20 is greater than the pressure in the commodity storage box 2 it swings forward, opening the intermediate opening 23, whereas if the pressure inside the rear face duct 20 is smaller than the pressure in the commodity storage box 2 it swings backward, opening the intermediate opening 23, and therefore if the lower-side in-box blower fan F1 and the upper-side in-box blower fan F2 are being forward-driven or if the lower-side in-box blower fan F1 and the upper-side in-box blower fan F2 are being reverse-driven, it is possible to prevent internal air which is passing through the rear face duct 20 from being discharged from the intermediate opening 23, and commodities accommodated in the commodity storage box 2 can be cooled satisfactorily.

According to the abovementioned automatic vending machine, the lower-side in-box blower fan F1 is provided to the front of the lower-side opening 21, and the upper-side in-box blower fan F2 is provided to the front of the upper-side opening 22, thereby allowing internal air to be circulated efficiently, and the cooling efficiency can thus be improved.

According to the abovementioned automatic vending machine, ventilation passages 34 are formed between the internal door 30*a* and the commodity-accommodating rack 10 by providing recessed portions 33 in the internal door 30*a*, and thus a portion of the air discharged from any of the openings in the rear face duct 20 can pass through said ventilation passages 34, and by this means cooled air can also be actively supplied to the front of the commodity-accommodating rack 10, and all of the commodities accommodated in the commodity-accommodating rack 10 can be cooled satisfactorily.

Preferred embodiments 1 and 2 of the present invention have been described hereinabove, but the present invention is not restricted to these and various modifications can be made.

In embodiments 1 and 2 discussed above the rear face duct 20 extends vertically in such a way that its uppermost portion is positioned in the upper region of the commodity-accommodating rack 10, and the upper-side in-box blower fan F2 is provided in front of the upper-side opening 22, but in the present invention it is also possible to adopt a configuration such as the following.

Figure 18:
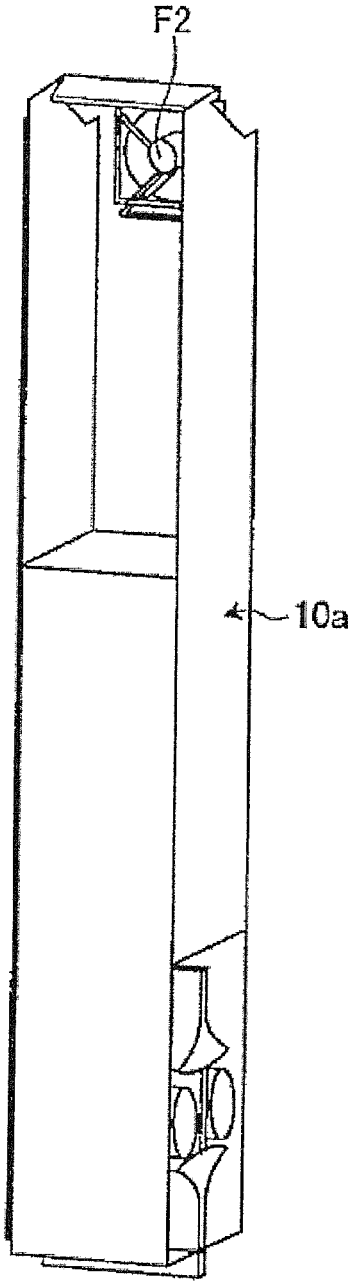
FIG. 18 is a perspective view illustrating a variation of a commodity-accommodating rack constituting the automatic vending machine according to the present invention.

FIG. 18 is a perspective view illustrating a variation of a commodity-accommodating rack constituting the automatic vending machine according to the present invention. As illustrated in FIG. 18, the upper-side in-box blower fan F2 may also be provided on the upper side of the commodity-accommodating region positioned furthest to the rear of the commodity-accommodating rack 10 (also referred to hereinbelow as 'rear rack 10*a*'). In this case, cushioning material, which is not shown in the drawing, is provided on a rear end portion of a side plate of the rear rack 10*a* in a manner such that it protrudes backward, and by bringing this cushioning material into contact with the rear face of the commodity storage box 2 it may be made to constitute part of the rear face duct. In other words, the rear face duct is configured by providing a duct made of cushioning material on the upper side of an existing duct which only exits up to the height level of a commodity several items up from the lowermost commodity accommodated in the commodity-accommodating rack. Then, with a rear face duct having such a configuration, an intermediate opening should be provided between the existing duct and the duct made of cushioning material. Thus also according to an automatic vending machine having this configuration, it is possible to exhibit operational advantages in that a lengthening of the commodity cold-maintaining operation time can be achieved and moreover there is no danger of commodity sales opportunities being lost, and in addition it is also possible to make effective use of existing automatic vending machines that are already available on the market, and a versatile automatic vending machine can thus be achieved.

In embodiments 1 and 2 discussed above, when the cooling recovery operation is being performed, driving of the lower-side in-box blower fan F1 and the upper-side in-box blower fan F2 is controlled based on the detected temperature from the intermediate in-box temperature sensor S3, but in the present invention this is not restricted to only the intermediate in-box temperature sensor S3, and driving of the lower-side in-box blower fan F1 and the upper-side in-box blower fan F2 may also be controlled based on the detected temperature from the lower in-box temperature sensor S1, the detected temperature from the upper in-box temperature sensor S2 or the average of the detected temperatures from the lower in-box temperature sensor S1, the upper in-box temperature sensor S2 and the intermediate in-box temperature sensor S3. Further, if driving of the lower-side in-box blower fan F1 and the upper-side in-box blower fan F2 is controlled based on the detected temperature from the lower in-box temperature sensor S1, the number of items sold from the commodity-accommodating rack may be measured, and driving of each in-box blower fan F1, F2 may be controlled based on whether or not said number of items sold is equal to or greater than a preset threshold.

In embodiment 2 discussed above, when the normal cooling operation is being performed, the magnitude of the number of commodities accommodated in the commodity-accommodating rack 10 is determined based on the detected temperature from the upper in-box temperature sensor S2, but in the present invention the magnitude of the number of commodities accommodated in the commodity-accommodating device (commodity-accommodating rack 10) may also be determined using various other methods.

In embodiment 2 discussed above, when the normal cooling operation is being performed, the upper-side in-box blower fan F2 is intermittently reverse-driven in such a way that its blowing rate is lower than that of the lower-side in-box blower fan F1, but in the present invention there is no particular restriction to the mode of operation provided that at least one of the lower-side in-box blower fan F1 and the upper-side in-box blower fan F2 can be driven in such a way that the blowing rate of said lower-side in-box blower fan F1 is larger, and for example the duty cycle of the lower-side in-box blower fan F1 may be made larger than that of the upper-side in-box blower fan F2, or it may be achieved by modifying the lower-side in-box blower fan F1 and the upper-side in-box blower fan F2 fan shapes, or the lower-side in-box blower fan F1 may be driven on its own, with the upper-side in-box blower fan F2 drive being stopped.

In embodiments 1 and 2 discussed above, the rear face duct 20 is shown by way of example as a duct disposed vertically in the commodity storage box 2, but the duct in the present invention is not restricted to this rear face duct 20, and it may also be a side face duct disposed vertically at the side of the commodity-accommodating device (commodity-accommodating rack 10).

In embodiments 1 and 2 discussed above, the evaporator 4*a*, being cooling means, is disposed in front of the lower-side in-box blower fan F1, but in the present invention there is no particular restriction to the position in which the cooling means are disposed, and they may be disposed in any position provided that air inside the commodity storage box 2 (internal atmosphere) can be cooled satisfactorily.

INDUSTRIAL APPLICABILITY

As explained hereinabove, the automatic vending machine according to the present invention is of use in the sale of commodities such as beverages in cans or beverages in PET bottles.

EXPLANATION OF THE REFERENCE NUMBERS

1 Main body cabinet
2 Commodity storage box
3 Commodity shooter
4*a* Evaporator
10 Commodity-accommodating rack
11 Side plate
12 Passage-forming member
13 Commodity-accommodating region
20 Rear face duct

21 Lower-side opening
22 Upper-side opening
23 Intermediate opening
24 Flapper member
24*a* Flapper member
30 Internal door
30*a* Internal door
31 Commodity-unloading port
32 Commodity-unloading door
33 Recessed portion
34 Ventilation passage
40 External door
42 Commodity removal port
43 Commodity removal door
50 Control means
51 Operation setting portion
52 Input-processing portion
53 Determination portion
54 Compressor drive processing portion
55 Fan drive processing portion
60 Memory
70 Control means
71 Operation setting portion
72 Input-processing portion
73 Determination portion
74 Compressor drive processing portion
75 Fan drive processing portion
80 Memory
F1 Lower-side in-box blower fan
F2 Upper-side in-box blower fan
H Heater
S1 Lower in-box temperature sensor
S2 Upper in-box temperature sensor
S3 Intermediate in-box temperature sensor

The invention claimed is:

1. An automatic vending machine comprising:

an automatic vending machine main body, an opening formed in a front face of which is opened and closed by means of a door body and inside which a commodity storage box is defined;

a commodity-accommodating device which is provided inside the commodity storage box and which vertically accommodates commodities that have been introduced thereinto and dispenses the lower most commodity when receiving a sell command;

a duct disposed vertically inside the commodity storage box and adjacent to the commodity-accommodating device, the duct having a lower-side opening at a lower side of the commodity storage box, an upper-side opening at an upper side of the commodity storage box and directly communicating with the lower-side opening, and an intermediate opening between the lower-side opening and the upper-side opening, and directly communicating with the lower-side opening and the upper-side opening;

a flapper member disposed swingably at the intermediate opening to close the intermediate opening by means of a weight of the flapper member and swing to open the intermediate opening if a pressure inside the duct is greater than a pressure outside the duct;

a cooler which is provided in the commodity storage box in a vicinity of the lower-side opening of the duct for cooling an internal atmosphere inside the commodity storage box;

a lower-side in-box blower fan disposed at the lower-side opening of the duct for circulating the internal atmosphere between the inside and the outside of the duct;

an upper-side in-box blower fan disposed at the upper-side opening of the duct for circulating the internal atmosphere between the inside and the outside of the duct; and a controller which, when a normal cooling operation is being performed, drives the lower-side in-box blower fan and the upper-side in-box blower fan such that the internal atmosphere which has been caused to enter the duct through the lower-side opening circulates within the commodity storage box in such a way that the internal atmosphere is discharged from the upper-side opening, thus cooling all of the commodities accommodated in the commodity-accommodating device, and which, when a cold-maintaining operation is being performed, stops driving the lower-side in-box blower fan and the upper-side in-box blower fan, and which further, when a cooling recovery operation is being performed subsequent to the cold-maintaining operation, drives the lower-side in-box blower fan and the upper-side in-box blower fan such that the internal atmosphere enters the duct through the lower-side opening and the upper-side opening to change the pressure difference between the inside of the duct and the outside of the duct so that the flapper member swings to open the intermediate opening and that the internal atmosphere which has entered the duct through the lower-side opening and the upper-side opening is discharged from the intermediate opening thereby cooling the commodities in a lower region from the intermediate opening, wherein the controller sequentially performs the normal cooling operation, the cold-maintaining operation, and the cooling recovery operation in accordance with a preset time schedule.

2. The automatic vending machine according to claim 1, wherein the lower-side opening is provided further toward the lower region than the commodity-accommodating device, and the upper-side opening is provided further toward an upper region than the commodity-accommodating device.

3. The automatic vending machine according to claim 1, wherein the lower-side in-box blower fan is provided in front of the lower-side opening, and the upper-side in-box blower fan is provided in front of the upper-side opening.

4. The automatic vending machine according to claim 1, wherein when the cooling recovery operation is being performed, if an internal temperature inside the commodity storage box is equal to or less than a predefined threshold, the controller drives the lower-side in-box blower fan and the upper-side in-box blower fan such that the internal atmosphere enters the duct through the lower-side opening and the upper-side opening and that the internal atmosphere which has entered the duct is discharged from the intermediate opening thereby cooling the commodities in the lower region from the intermediate opening, and if the internal temperature exceeds the predetermined threshold, the controller drives the lower-side in-box blower fan and the upper-side in-box blower fan such that the internal atmosphere which has cooled the commodities accommodated in the commodity-accommodating device circulates within the commodity storage box in such a way that the internal atmosphere enters the duct through the upper-side opening and is discharged from the lower-side opening thereby cooling the commodities accommodated in the commodity-accommodating device.

5. The automatic vending machine according to claim 1, further comprising a ventilation passage that allows the internal atmosphere to pass between an internal door which constitutes the door body and which opens and closes a front face opening of the commodity storage box, and the commodity-accommodating device in the commodity storage box.

6. The automatic vending machine according to claim 1, further comprising:

an intermediate in-box temperature sensor disposed at a height corresponding to the intermediate opening for detecting a temperature inside the commodity storage box at an intermediate region, wherein when the cooling recovery operation is being performed, and when the intermediate in-box temperature sensor detects the temperature of the commodity storage box at the intermediate region of the commodity storage box to be equal or lower than a predetermined temperature, the controller drives the lower-side in-box blower fan and the upper-side in-box blower fan to allow the internal atmosphere to enter the duct through the lower-side opening and the upper-side opening to change the pressure difference between the inside of the duct and the outside of the duct so that the flapper member swings to open the intermediate opening and allow the internal atmosphere to discharge from the duct through the intermediate opening, and when the intermediate in-box temperature sensor detects the temperature of the commodity storage box at the intermediate region to be greater than the predetermined temperature, the controller drives the lower-side in-box blower fan and the upper-side in-box blower fan to allow the internal atmosphere to enter the duct through the upper-side opening and discharge from the duct through the lower-side opening, while the flapper member closes the intermediate opening.

7. An automatic vending machine comprising:

an automatic vending machine main body, an opening formed in a front face of which is opened and closed by means of a door body and inside which a commodity storage box is defined;

a commodity-accommodating device which is provided inside the commodity storage box and which vertically accommodates commodities that have been introduced thereinto and dispenses the lower most commodity when receiving a sell command;

a duct disposed vertically inside the commodity storage box and adjacent to the commodity-accommodating device, the duct having a lower-side opening at a lower side of the commodity storage box, an upper-side opening at an upper side of the commodity storage box and directly communicating with the lower-side opening, and an intermediate opening between the lower-side opening and the upper-side opening, and directly communicating with the lower-side opening and the upper-side opening;

a flapper member disposed swingably at the intermediate opening to close the intermediate opening by means of a weight of the flapper member and swing to open the intermediate opening if a pressure inside the duct is greater than a pressure outside the duct;

a cooler which is provided in the commodity storage box in a vicinity of the lower-side opening of the duct for cooling an internal atmosphere inside the commodity storage box;

a lower-side in-box blower fan disposed at the lower-side opening of the duct for circulating the internal atmosphere between the inside and the outside of the duct;

an upper-side in-box blower fan disposed at the upper-side opening of the duct for circulating the internal atmosphere between the inside and the outside of the duct; and a controller which, when a normal cooling operation is being performed, drives at least one of the lower-side in-box blower fan and the upper-side in-box blower fan in such a way that a blowing rate of the lower-side in-box blower fan is larger relative to that of the upper-side in-box blower fan such that at least a portion of the internal atmosphere which has been discharged from the duct through the lower-side opening circulates within the commodity storage box and changes the pressure difference between the inside of the duct and the outside of the duct in such a way that the flapper member swings to open the intermediate opening and the internal atmosphere enters the duct through the intermediate opening, thus cooling the commodities accommodated in a lower region of the commodity-accommodating device, and which, when a cold-maintaining operation is being performed, stops driving the lower-side in-box blower fan and the upper-side in-box blower fan, and which further, when a cooling recovery operation is being performed subsequent to the cold-maintaining operation, drives the lower-side in-box blower fan and the upper-side in-box blower fan such that the internal atmosphere enters the duct through the lower-side opening and the upper-side opening to change the pressure difference between the inside of the duct and the outside of the duct so that the flapper member swings to open the intermediate opening and the internal atmosphere which has entered the duct is discharged from the intermediate opening thereby cooling the commodities in the lower region from the intermediate opening, wherein the controller sequentially performs the normal cooling operation, the cold-maintaining operation, and the cooling recovery operation in accordance with a preset time schedule.

8. The automatic vending machine according to claim 7, wherein the lower-side opening is provided further toward the lower region than the commodity-accommodating device, and the upper-side opening is provided further toward an upper region than the commodity-accommodating device.

9. The automatic vending machine according to claim 7, wherein the lower-side in-box blower fan is provided in front of the lower-side opening, and the upper-side in-box blower fan is provided in front of the upper-side opening.

10. The automatic vending machine according to claim 7, wherein when the cooling recovery operation is being performed, if an internal temperature inside the commodity storage box is equal to or less than a predefined threshold, the controller drives the lower-side in-box blower tan and the upper-side in-box blower fan such that the internal atmosphere enters the duct through the lower-side opening and the upper-side opening and that the internal atmosphere which has entered the duct is discharged from the intermediate opening thereby cooling the commodities in the lower region from the intermediate opening, and if the internal temperature exceeds the threshold, the controller drives the lower-side in-box blower fan and the upper-side in-box blower fan such that internal atmosphere which has cooled the commodities accommodated in the commodity-accommodating device circulates within the commodity storage box in such a way that the internal atmosphere enters the duct through the upper-side opening and is discharged from the lower-side opening thereby cooling the commodities accommodated in the commodity-accommodating device.

11. The automatic vending machine according to claim 7, further comprising a ventilation passage that allows the internal atmosphere to pass between an internal door which constitutes the door body and which opens and closes a front face opening of the commodity storage box, and the commodity-accommodating device in the commodity storage box.

12. The automatic vending machine according to claim 7, further comprising:

an upper in-box temperature sensor disposed inside the commodity storage box at an upper region for detecting a temperature at the upper region, wherein when the normal cooling operation is being performed, and when the upper in-box temperature sensor detects the temperature of the commodity storage box at the upper region to be lower than a predetermined judgement temperature, the controller increases the blowing rate of the lower-side in-box blower fan than that of the upper-side in-box blower fan to change the pressure difference between the inside of the duct and the outside of the duct so that the flapper member swings to open the intermediate opening and allow at least the portion of the internal atmosphere discharged from the duct through the lower-side opening to enter the duct through the intermediate opening, and when the upper in-box temperature sensor detects the temperature of the commodity storage box at the upper region to be equal to or greater than the predetermined judgement temperature, the controller drives the lower-side in-box blower fan and the upper-side in-box blower fan to allow the internal atmosphere to enter the duct through the lower-side opening and discharge from the duct through the upper-side opening, while the flapper member closes the intermediate opening.

13. The automatic vending machine according to claim 12, further comprising:

an intermediate in-box temperature sensor disposed at a height corresponding to the intermediate opening for detecting the temperature inside the commodity storage box at an intermediate region, wherein when the cooling recovery operation is being performed, and when the intermediate in-box temperature sensor detects the temperature of the commodity storage box at the intermediate region of the commodity storage box to be equal or lower than a predetermined reference temperature, the controller drives the lower-side in-box blower fan and the upper-side in-box blower fan to allow the internal atmosphere to enter the duct through the lower-side opening and the upper-side opening to change the pressure difference between the inside and outside of the duct so that the flapper member swings to open the intermediate opening and allow the internal atmosphere to discharge from the duct through the intermediate opening, and when the intermediate in-box temperature sensor detects the temperature of the commodity storage box at the intermediate region to be greater than the predetermined reference temperature, the controller drives the lower-side in-box blower fan and the upper-side in-box blower fan to allow the internal atmosphere to enter the duct through the upper-side opening and discharge from the duct through the lower-side opening, while the flapper member closes the intermediate opening.

14. The automatic vending machine according to claim 7, wherein when the normal cooling operation is being performed, the controller drives the lower-side in-box blower fan and the upper-side in-box blower fan so that the internal atmosphere enters the duct through the upper-side opening and the intermediate opening, and is discharged from the lower-side opening.

* * * * *